US011834143B2

(12) United States Patent
Shirao et al.

(10) Patent No.: US 11,834,143 B2
(45) Date of Patent: Dec. 5, 2023

(54) CONTROL DEVICE FOR OUTBOARD MOTOR, CONTROL METHOD FOR OUTBOARD MOTOR, AND PROGRAM

(71) Applicant: NHK SPRING Co., Ltd., Yokohama (JP)

(72) Inventors: Masato Shirao, Yokohama (JP); Marino Akita, Yokohama (JP); Takafumi Oshima, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 207 days.

(21) Appl. No.: 17/422,658

(22) PCT Filed: Feb. 14, 2020

(86) PCT No.: PCT/IB2020/051234

§ 371 (c)(1),
(2) Date: Jul. 13, 2021

(87) PCT Pub. No.: WO2020/148738

PCT Pub. Date: Jul. 23, 2020

(65) Prior Publication Data

US 2022/0081085 A1 Mar. 17, 2022

(30) Foreign Application Priority Data

Jan. 18, 2019 (JP) ..... 2019-007330

(51) Int. Cl.
*B63H 20/12* (2006.01)
*B63H 21/21* (2006.01)
(Continued)

(52) U.S. Cl.
CPC ..... *B63H 20/12* (2013.01); *B63H 21/21* (2013.01); *B63H 25/02* (2013.01); *B63H 25/42* (2013.01);
(Continued)

(58) Field of Classification Search
CPC ..... B63H 20/12; B63H 21/21; B63H 25/02; B63H 25/42; B63H 2020/003; B63H 2025/026
See application file for complete search history.

(56) References Cited

U.S. PATENT DOCUMENTS 4,271,780 A 6/1981 Etoh
8,589,004 B1 * 11/2013 Kanno ..... B63H 25/42 440/4
(Continued)

FOREIGN PATENT DOCUMENTS

EP 2343236 A1 7/2011
JP H01285486 A 11/1989
(Continued)

OTHER PUBLICATIONS

EPO Extended European Search Report for corresponding EP Application No. 20742124.9; dated Oct. 11, 2022.
(Continued)

*Primary Examiner* — Stephen P Avila
(74) *Attorney, Agent, or Firm* — CANTOR COLBURN LLP

(57) ABSTRACT

A control device for an outboard motor controls a plurality of outboard motors included in a ship. Each outboard motor includes a propulsion unit and a steering actuator. The ship includes an operation unit that operates the steering actuator and the propulsion unit. The operation unit can be positioned at a first position at which the outboard motors do not generate a propulsion force for the ship, a second position at which the outboard motors generate a propulsion force for moving the ship in a leftward-rightward direction, and a third position at which the outboard motors generate a propulsion force for moving the ship in an oblique direction that forms an acute angle with the leftward-rightward direction. A forward-backward direction component of a propulsion force in the oblique direction which is generated by the outboard motors.

4 Claims, 9 Drawing Sheets

(51) Int. Cl.
*B63H 25/02* (2006.01)
*B63H 25/42* (2006.01)
*B63H 20/00* (2006.01)

(52) U.S. Cl.
CPC .. *B63H 2020/003* (2013.01); *B63H 2025/026* (2013.01)

(56) References Cited

U.S. PATENT DOCUMENTS

| | | | | |
|---|---|---|---|---|
| 2015/0072575 | A1* | 3/2015 | Mizutani ..... | B63H 20/12 440/1 |
| 2015/0166159 | A1 | 6/2015 | Inoue et al. | |

FOREIGN PATENT DOCUMENTS

| | | | |
|---|---|---|---|
| JP | 08216989 | A | 8/1996 |
| JP | 2015116847 | A | 6/2015 |
| JP | 5987624 | B2 | 7/2016 |
| WO | 2010039952 | A1 | 4/2010 |

OTHER PUBLICATIONS

International Search Report for International Application No. PCT/IB2020/051234; dated Apr. 7, 2020.

* cited by examiner

CONTROL DEVICE FOR OUTBOARD MOTOR, CONTROL METHOD FOR OUTBOARD MOTOR, AND PROGRAM

CROSS REFERENCE TO RELATED APPLICATIONS

This is the U.S. national stage of application No. PCT/IB2020/051234, filed on Feb. 14, 2020. Priority under 35 U.S.C. § 119(a) and 35 U.S.C. § 365(b) is claimed from Japanese Application No. 2019-007330 filed Jan. 18, 2019, the disclosure of which is also incorporated herein by reference.

TECHNICAL FIELD

The present invention relates to a control device for an outboard motor, a control method for an outboard motor, and a program.

BACKGROUND ART

In the related art, a maneuvering device for a ship which is capable of moving and turning in an arbitrary direction is known (see, for example, Patent Literature 1). In the technique described in Patent Literature 1, two propulsion devices that can arbitrarily set the direction and strength of propulsion force are installed on the left and right sides of a stern, and the direction and the strength of the propulsion force of each propulsion device are controlled. As a result, a synthetic force for moving the ship in a desired direction and a synthetic force for turning the ship in a desired direction act on a ship hull. In detail, in Patent Literature 1, a joystick is described as an omnidirectional controller, and an example in which the ship hull moves to the side while maintaining its posture is described. Further, in Patent Literature 1, an example in which the ship hull moves obliquely forward or obliquely backward while maintaining its posture is described.

Incidentally, in Patent Literature 1, there is no description about the magnitude of a forward-backward direction component of a propulsion force (a synthetic force) in a rightward-forward direction generated by the two propulsion devices in a case in which a tip end portion of a lever of the joystick is moved from a neutral position at which the tip end portion is positioned when the lever is not tilted to a rightward-forward tilt position at which the tip end portion is positioned when the lever is tilted in a rightward-forward direction via a rightward tilt position at which the tip end portion is positioned when the lever is tilted in a rightward direction.

Further, in Patent Literature 1, there is no description about the magnitude of a forward-backward direction component of a propulsion force (a synthetic force) in a rightward-forward direction generated by the two propulsion devices in a case in which the tip end portion of the lever of the joystick is moved directly from the neutral position to the rightward-forward tilt position.

Further, in the related art, a control device that controls two outboard motors attached to a ship according to an operation by a joystick capable of tilting from a neutral state in all directions is known (see, for example, Patent Literature 2). In the technique described in Patent Literature 2, in a case in which the joystick is tilted to a rightward side, the control device causes the two outboard motors to generate a propulsion force for translating the ship in a rightward direction in parallel. Further, in the technique described in Patent Literature 2, in a case in which the joystick is tilted to a rightward-forward side, the control device causes the two outboard motors to generate a propulsion force for translating the ship in a rightward-forward direction in parallel.

Incidentally, in Patent Literature 2, there is no description about the relationship between the magnitude of a forward-backward direction component of a propulsion force (a synthetic force) in a rightward-forward direction generated by the two outboard motors in a case in which a tip end portion of a lever of the joystick is moved from a neutral position to a rightward-forward tilt position via a rightward tilt position and the magnitude of a forward-backward direction component of a propulsion force (a synthetic force) in a rightward-forward direction generated by the two outboard motors in a case in which a tip end portion of a lever of the joystick is moved directly from a neutral position to a rightward-forward tilt position.

CITATION LIST

Patent Literature

[Patent Document 1]
Japanese Unexamined Patent Application, First Publication No. H1-285486
[Patent Document 2]
Japanese Patent No. 5987624

SUMMARY OF INVENTION

Technical Problem

For example, in a case in which, during a period in which the ship is moved in the rightward direction by the tip end portion of the lever of the joystick being moved from the neutral position to the rightward tilt position, the ship receives a force in a backward direction due to, for example, wind, tidal current, and the like, the ship operator moves the tip end portion of the lever of the joystick from the rightward tilt position to the rightward-forward tilt position to move the ship in the rightward direction without the ship being swept in the backward direction.

Through diligent research, the present inventors have found that, in a case in which the magnitudes of the forward-backward direction component and the leftward-rightward direction component of the propulsion force in the rightward-forward direction which is generated by the outboard motors when the tip end portion of the lever of the joystick is moved from the neutral position to the rightward-forward tilt position via the rightward tilt position and the magnitudes of the forward-backward direction component and the leftward-rightward direction component of the propulsion force in the rightward-forward direction which is generated by the outboard motors when the tip end portion of the lever of the joystick is moved directly from the neutral position to the rightward-forward tilt position are set to be equal to each other, the magnitude of the forward-backward direction component of the propulsion force against the force in the backward direction due to wind, tidal current, and the like is not sufficient and the ship may be swept in the backward direction without being moved in the rightward direction as desired by the ship operator.

In addition, even in a case in which the ship does not receive the force in the backward direction due to, for example, wind, tidal current, and the like, the ship operator may move the tip end portion of the lever of the joystick from the rightward tilt position to the rightward-forward tilt position to switch (finely correct or correct) the direction of the ship moving in the rightward direction from the rightward direction to the rightward-forward direction.

Through diligent research, the present inventors have found that, since an inertial force in the rightward direction is generated in the ship moving in the rightward direction, in a case in which the magnitudes of the forward-backward direction component and the leftward-rightward direction component of the propulsion force in the rightward-forward direction which is generated by the outboard motors when the tip end portion of the lever of the joystick is moved from the neutral position to the rightward-forward tilt position via the rightward tilt position and the magnitudes of the forward-backward direction component and the leftward-rightward direction component of the propulsion force in the rightward-forward direction which is generated by the outboard motors when the tip end portion of the lever of the joystick is moved directly from the neutral position to the rightward-forward tilt position are set to be equal to each other, the ship operator may feel that a response operation of the ship to the correction operation of the ship operator is slow (that is, the switching of the direction of the ship from the rightward direction to the rightward-forward direction is slow).

In view of the above-described problems, an object of the present invention is to provide a control device for an outboard motor, a control method for an outboard motor, and a program in which, even in a case in which a ship receives a force in a forward-backward direction during an operation of moving the ship in the leftward-rightward direction, it is possible to move the ship in the leftward-rightward direction without it being swept in the forward-backward direction and it is possible to quickly switch a direction of the ship moving in the leftward-rightward direction to an oblique direction.

Solution to Problem

Through diligent research, the present inventors have found that, for example, in a case in which the forward-backward direction component of the propulsion force in the rightward-forward direction which is generated by the outboard motors when the tip end portion of the lever of the joystick is moved from the neutral position to the rightward-forward tilt position via the rightward tilt position is set to be larger than the forward-backward direction component of the propulsion force in the rightward-forward direction which is generated by the outboard motors when the tip end portion of the lever of the joystick is moved directly from the neutral position to the rightward-forward tilt position, or in a case in which the leftward-rightward direction component of the propulsion force in the rightward-forward direction which is generated by the outboard motors when the tip end portion of the lever of the joystick is moved from the neutral position to the rightward-forward tilt position via the rightward tilt position is set to be smaller than the leftward-rightward direction component of the propulsion force in the rightward-forward direction which is generated by the outboard motors when the tip end portion of the lever of the joystick is moved directly from the neutral position to the rightward-forward tilt position (that is, in a case in which an acute angle formed between the propulsion force in the rightward-forward direction which is generated by the outboard motors when the tip end portion of the lever of the joystick is moved from the neutral position to the rightward-forward tilt position via the rightward tilt position and the forward-backward direction component of the propulsion force is smaller than an acute angle formed between the propulsion force in the rightward-forward direction which is generated by the outboard motors when the tip end portion of the lever of the joystick is moved directly from the neutral position to the rightward-forward tilt position and the forward-backward direction component of the propulsion force), it is possible to move the ship in the rightward direction according to the desire of the ship operator without the ship being swept in the backward direction due to wind, tidal current, and the like.

Through diligent research, the present inventors have found that, for example, in a case in which the forward-backward direction component of the propulsion force in the rightward-forward direction which is generated by the outboard motors when the tip end portion of the lever of the joystick is moved from the neutral position to the rightward-forward tilt position via the rightward tilt position is set to be larger than the forward-backward direction component of the propulsion force in the rightward-forward direction which is generated by the outboard motors when the tip end portion of the lever of the joystick is moved directly from the neutral position to the rightward-forward tilt position, or in a case in which the leftward-rightward direction component of the propulsion force in the rightward-forward direction which is generated by the outboard motors when the tip end portion of the lever of the joystick is moved from the neutral position to the rightward-forward tilt position via the rightward tilt position is set to be smaller than the leftward-rightward direction component of the propulsion force in the rightward-forward direction which is generated by the outboard motors when the tip end portion of the lever of the joystick is moved directly from the neutral position to the rightward-forward tilt position (that is, in a case in which an acute angle formed between the propulsion force in the rightward-forward direction which is generated by the outboard motors when the tip end portion of the lever of the joystick is moved from the neutral position to the rightward-forward tilt position via the rightward tilt position and the forward-backward direction component of the propulsion force is smaller than an acute angle formed between the propulsion force in the rightward-forward direction which is generated by the outboard motors when the tip end portion of the lever of the joystick is moved directly from the neutral position to the rightward-forward tilt position and the forward-backward direction component of the propulsion force), it is possible to quickly switch the direction of the ship moving in the rightward direction to the rightward-forward direction according to the desire of the ship operator.

According to an aspect of the present invention, there is provided a control device for an outboard motor which controls a plurality of outboard motors included in a ship, wherein each of the plurality of outboard motors includes a propulsion unit configured to generate a propulsion force for the ship and a steering actuator, wherein the ship includes an operation unit configured to operate the steering actuator and the propulsion unit, wherein the operation unit can be positioned at least at a first position which is a position at which the plurality of outboard motors do not generate a propulsion force for the ship, a second position which is a position at which the plurality of outboard motors generate a propulsion force for moving the ship in a leftward-rightward direction, and a third position which is a position at which the plurality of outboard motors generate a propulsion force for moving the ship in an oblique direction that forms an acute angle with the leftward-rightward direction, and wherein a forward-backward direction component of a propulsion force in the oblique direction which the control device for an outboard motor causes the plurality of outboard motors to generate in a case in which the operation unit is moved from the first position to the third position via the second position is larger than a forward-backward direction component of a propulsion force in the oblique direction which the control device for an outboard motor causes the plurality of outboard motors to generate in a case in which the operation unit is moved directly from the first position to the third position, or a leftward-rightward direction component of the propulsion force in the oblique direction which the control device for an outboard motor causes the plurality of outboard motors to generate in a case in which the operation unit is moved from the first position to the third position via the second position is smaller than a leftward-rightward direction component of the propulsion force in the oblique direction which the control device for an outboard motor causes the plurality of outboard motors to generate in a case in which the operation unit is moved directly from the first position to the third position (that is, an acute angle formed between the propulsion force in the oblique direction which the control device for an outboard motor causes the plurality of outboard motors to generate when the operation unit is moved from the first position to the third position via the second position and the forward-backward direction component of the propulsion force is smaller than an acute angle formed between the propulsion force in the oblique direction which the control device for an outboard motor causes the plurality of outboard motors to generate when the operation unit is moved directly from the first position to the third position and the forward-backward direction component of the propulsion force).

The control device for an outboard motor according to the aspect of the present invention may include: a movement route calculation unit configured to calculate a movement route of the operation unit; and a propulsion force calculation unit configured to calculate the propulsion force generated by the plurality of outboard motors based on the movement route of the operation unit calculated by the movement route calculation unit.

In the control device for an outboard motor according to the aspect of the present invention, the second position may include a rightward position which is a position on a rightward side from the first position and at which the plurality of outboard motors generate a propulsion force for moving the ship in a rightward direction and a leftward position which is a position on a leftward side from the first position and at which the plurality of outboard motors generate a propulsion force for moving the ship in a leftward direction, the third position may include a rightward-forward position which is a position on a rightward-forward side from the first position and at which the plurality of outboard motors generate a propulsion force for moving the ship in a rightward-forward direction, a rightward-backward position which is a position on a rightward-backward side from the first position and at which the plurality of outboard motors generate a propulsion force for moving the ship in a rightward-backward direction, a leftward-forward position which is a position on a leftward-forward side from the first position and at which the plurality of outboard motors generate a propulsion force for moving the ship in a leftward-forward direction, and a leftward-backward position which is a position on a leftward-backward side from the first position and at which the plurality of outboard motors generate a propulsion force for moving the ship in a leftward-backward direction, a forward-backward direction component of a propulsion force in the rightward-forward direction which the propulsion force calculation unit calculates in a case in which the operation unit is moved from the first position to the rightward-forward position via the rightward position may be larger than a forward-backward direction component of a propulsion force in the rightward-forward direction which the propulsion force calculation unit calculates in a case in which the operation unit is moved directly from the first position to the rightward-forward position, or a leftward-rightward direction component of a propulsion force in the rightward-forward direction which the propulsion force calculation unit calculates in a case in which the operation unit is moved from the first position to the rightward-forward position via the rightward position may be smaller than a leftward-rightward direction component of a propulsion force in the rightward-forward direction which the propulsion force calculation unit calculates in a case in which the operation unit is moved directly from the first position to the rightward-forward position, a forward-backward direction component of a propulsion force in the rightward-backward direction which the propulsion force calculation unit calculates in a case in which the operation unit is moved from the first position to the rightward-backward position via the rightward position may be larger than a forward-backward direction component of a propulsion force in the rightward-backward direction which the propulsion force calculation unit calculates in a case in which the operation unit is moved directly from the first position to the rightward-backward position, or a leftward-rightward direction component of a propulsion force in the rightward-backward direction which the propulsion force calculation unit calculates in a case in which the operation unit is moved from the first position to the rightward-backward position via the rightward position may be smaller than a leftward-rightward direction component of a propulsion force in the rightward-backward direction which the propulsion force calculation unit calculates in a case in which the operation unit is moved directly from the first position to the rightward-backward position, a forward-backward direction component of a propulsion force in the leftward-forward direction which the propulsion force calculation unit calculates in a case in which the operation unit is moved from the first position to the leftward-forward position via the leftward position may be larger than a forward-backward direction component of a propulsion force in the leftward-forward direction which the propulsion force calculation unit calculates in a case in which the operation unit is moved directly from the first position to the leftward-forward position, or a leftward-rightward direction component of a propulsion force in the leftward-forward direction which the propulsion force calculation unit calculates in a case in which the operation unit is moved from the first position to the leftward-forward position via the leftward position may be smaller than a leftward-rightward direction component of a propulsion force in the leftward-forward direction which the propulsion force calculation unit calculates in a case in which the operation unit is moved directly from the first position to the leftward-forward position, and a forward-backward direction component of a propulsion force in the leftward-backward direction which the propulsion force calculation unit calculates in a case in which the operation unit is moved from the first position to the leftward-backward position via the leftward position may be larger than a forward-backward direction component of a propulsion force in the leftward-backward direction which the propulsion force calculation unit calculates in a case in which the operation unit is moved directly from the first position to the leftward-backward position, or a leftward-rightward direction component of a propulsion force in the leftward-backward direction which the propulsion force calculation unit calculates in a case in which the operation unit is moved from the first position to the leftward-backward position via the leftward position may be smaller than a leftward-rightward direction component of a propulsion force in the leftward-backward direction which the propulsion force calculation unit calculates in a case in which the operation unit is moved directly from the first position to the leftward-backward position.

According to another aspect of the present invention, there is provided a control method for an outboard motor in which a plurality of outboard motors included in a ship are controlled, wherein each of the plurality of outboard motors includes a propulsion unit configured to generate a propulsion force for the ship and a steering actuator, wherein the ship includes an operation unit configured to operate the steering actuator and the propulsion unit, wherein the operation unit can be positioned at least at a first position which is a position at which the plurality of outboard motors do not generate a propulsion force for the ship, a second position which is a position at which the plurality of outboard motors generate a propulsion force for moving the ship in a leftward-rightward direction, and a third position which is a position at which the plurality of outboard motors generate a propulsion force for moving the ship in an oblique direction that forms an acute angle with the leftward-rightward direction, and wherein the method includes: a first step of causing the plurality of outboard motors to generate propulsion force in a first oblique direction in a case in which the operation unit is moved directly from the first position to the third position; and a second step of causing the plurality of outboard motors to generate a propulsion force in a second oblique direction in a case in which the operation unit is moved from the first position to the third position via the second position, and wherein a forward-backward direction component of the propulsion force in the second oblique direction generated by the plurality of outboard motors in the second step is larger than a forward-backward direction component of the propulsion force in the first oblique direction generated by the plurality of outboard motors in the first step, or a leftward-rightward direction component of the propulsion force in the second oblique direction generated by the plurality of outboard motors in the second step is smaller than a leftward-rightward direction component of the propulsion force in the first oblique direction generated by the plurality of outboard motors in the first step.

According to still another aspect of the present invention, there is provided a program in which a plurality of outboard motors included in a ship are controlled, wherein each of the plurality of outboard motors includes a propulsion unit configured to generate a propulsion force for the ship and a steering actuator, wherein the ship includes an operation unit configured to operate the steering actuator and the propulsion unit, wherein the operation unit can be positioned at least at a first position which is a position at which the plurality of outboard motors do not generate a propulsion force for the ship, a second position which is a position at which the plurality of outboard motors generate a propulsion force for moving the ship in a leftward-rightward direction, and a third position which is a position at which the plurality of outboard motors generate a propulsion force for moving the ship in an oblique direction that forms an acute angle with the leftward-rightward direction, and wherein the program causes a computer mounted on the ship to execute a first step of causing the plurality of outboard motors to generate a propulsion force in a first oblique direction in a case in which the operation unit is moved directly from the first position to the third position; and a second step of causing the plurality of outboard motors to generate a propulsion force in a second oblique direction in a case in which the operation unit is moved from the first position to the third position via the second position, and wherein a forward-backward direction component of the propulsion force in the second oblique direction generated by the plurality of outboard motors in the second step is larger than a forward-backward direction component of the propulsion force in the first oblique direction generated by the plurality of outboard motors in the first step, or a leftward-rightward direction component of the propulsion force in the second oblique direction generated by the plurality of outboard motors in the second step is smaller than a leftward-rightward direction component of the propulsion force in the first oblique direction generated by the plurality of outboard motors in the first step.

Advantageous Effects of Invention

According to the present invention, it is possible to provide a control device for an outboard motor, a control method for an outboard motor, and a program in which, even in a case in which a ship receives a force in a forward-backward direction during an operation of moving the ship in the leftward-rightward direction, it is possible to move the ship in the leftward-rightward direction without it being swept in the forward-backward direction and it is possible to quickly switch a direction of the ship moving in the leftward-rightward direction to an oblique direction.

DESCRIPTION OF EMBODIMENTS

First Embodiment

Hereinafter, a first embodiment of a control device for an outboard motor, a control method for an outboard motor, and a program of the present invention will be described.

Figure 1:
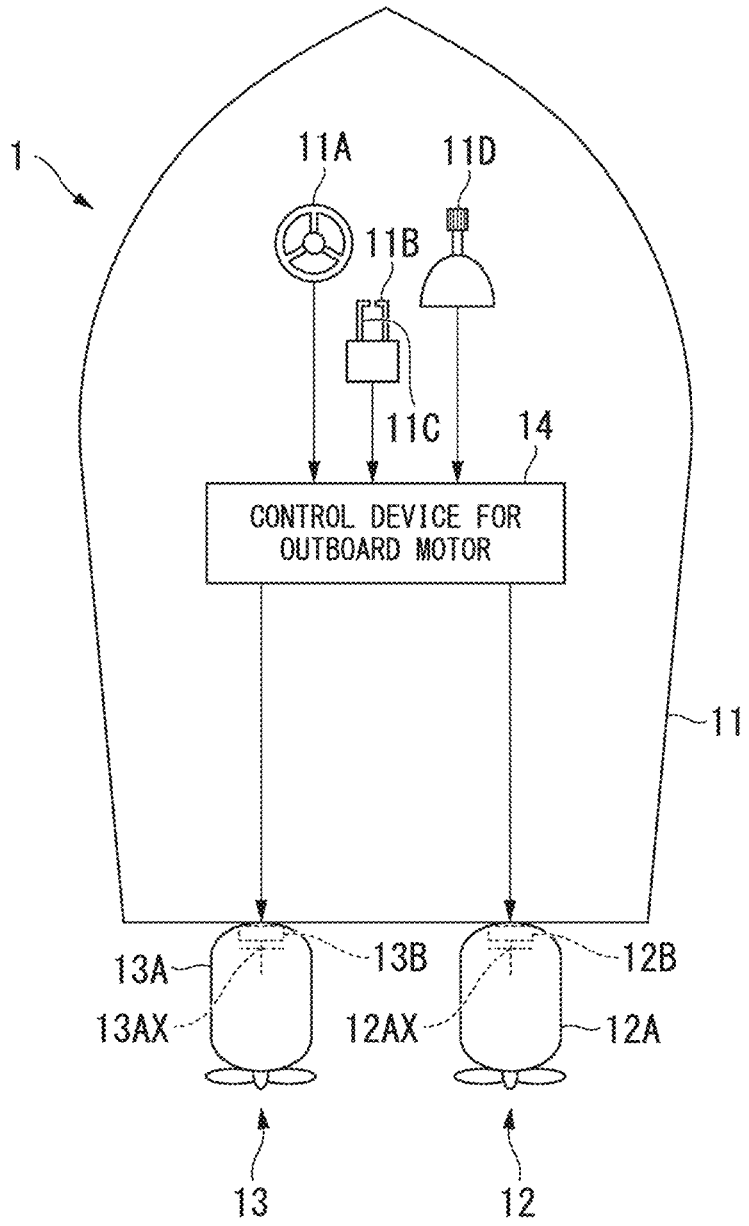
FIG. 1 is a diagram showing an example of a ship to which a control device for an outboard motor of a first embodiment is applied.
Figure 2:
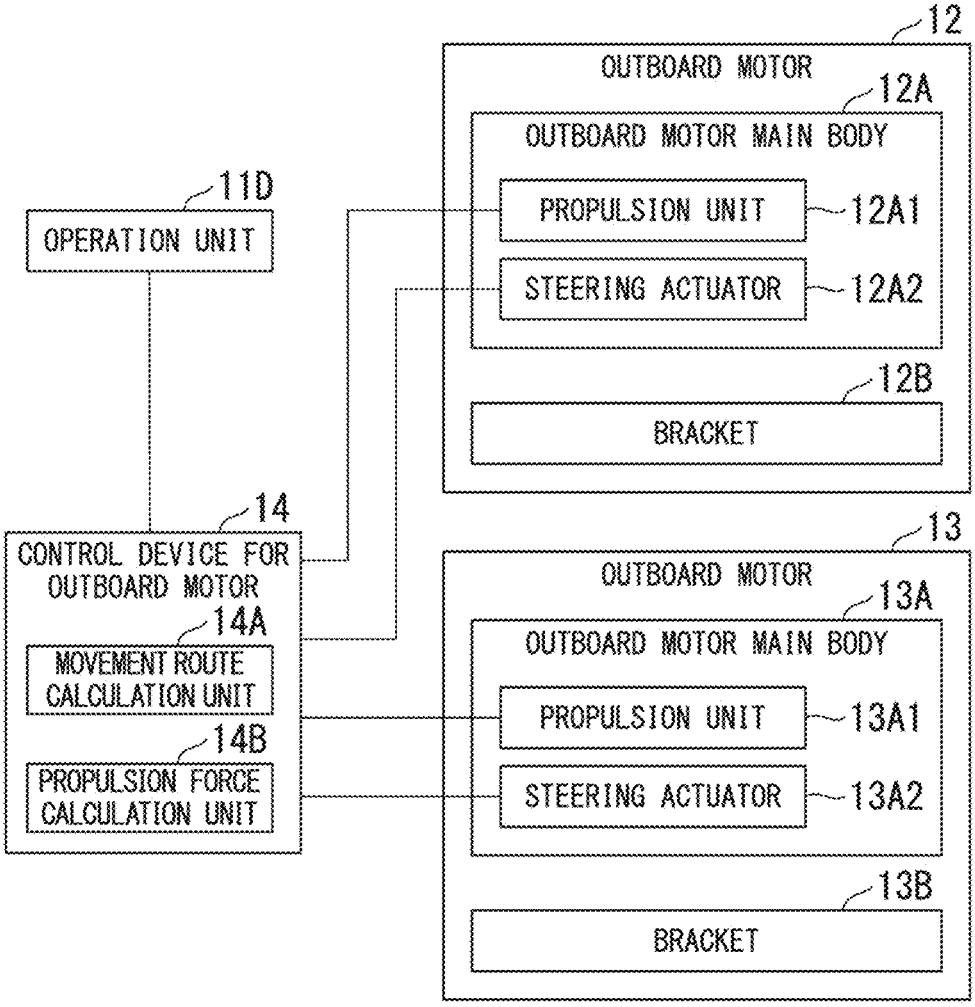
FIG. 2 is a functional block diagram of main parts of the ship shown in FIG. 1.

FIG. 1 is a diagram showing an example of a ship 1 to which a control device 14 for an outboard motor of the first embodiment is applied. FIG. 2 is a functional block diagram of main parts of the ship 1 shown in FIG. 1.

In the example shown in FIGS. 1 and FIG. 2, the ship 1 includes a ship hull 11, an outboard motor 12, an outboard motor 13, and a control device 14 for an outboard motor. The outboard motors 12 and 13 are propulsion units of the ship 1.

In the example shown in FIGS. 1 and FIG. 2, the ship 1 includes two outboard motors 12 and 13, but in another example, the ship 1 may include three or more outboard motors.

In the examples shown in FIGS. 1 and FIG. 2, the outboard motor 12 is attached to a right rear portion of the ship hull 11. The outboard motor 12 includes an outboard motor main body 12A and a bracket 12B. The bracket 12B is a mechanism for attaching the outboard motor 12 to the right rear portion of the ship hull 11. The outboard motor main body 12A is connected to the right rear portion of the ship hull 11 via the bracket 12B to be rotatable with respect to the ship hull 11 around a steering axis 12AX.

The outboard motor main body 12A includes a propulsion unit 12A1 and a steering actuator 12A2. The propulsion unit 12A1 is, for example, a propulsion unit in a propeller specification which is driven by an engine (not shown) and generates a propulsion force for the ship 1. In another example, the propulsion unit 12A1 may be a propulsion unit in a water jet specification.

The steering actuator 12A2 rotates the entire outboard motor main body 12A including the propulsion unit 12A1 with respect to the ship hull 11 around the steering axis 12AX. The steering actuator 12A2 serves as a rudder.

In the example shown in FIGS. 1 and FIG. 2, the outboard motor 13 is attached to a left rear portion of the ship hull 11. The outboard motor 13 includes an outboard motor main body 13A and a bracket 13B. The bracket 13B is a mechanism for attaching the outboard motor 13 to the left rear portion of the ship hull 11. The outboard motor main body 13A is connected to the left rear portion of the ship hull 11 via the bracket 13B to be rotatable with respect to the ship hull 11 around a steering axis 13AX.

The outboard motor main body 13A includes a propulsion unit 13A1 and a steering actuator 13A2. Like the propulsion unit 12A1, the propulsion unit 13A1 is, for example, a propulsion unit in a propeller specification and generates a propulsion force for the ship 1. In another example, the propulsion unit 13A1 may be a propulsion unit in a water jet specification.

The steering actuator 13A2 rotates the entire outboard motor main body 13A including the propulsion unit 13A1 with respect to the ship hull 11 around the steering axis 13AX. The steering actuator 13A2 serves as a rudder.

In the example shown in FIGS. 1 and FIG. 2, the ship hull 11 includes a steering device 11A, a remote control device 11B, a remote control device 11C, and an operation unit 11D.

In another example, the ship hull 11 may not include the steering device 11A, the remote control device 11B, and the remote control device 11C.

In the example shown in FIGS. 1 and FIG. 2, the steering device 11A is a device that operates the steering actuators 12A2 and 13A2 and is, for example, a steering device having a steering wheel. By operating the steering device 11A, the ship operator can operate the steering actuators 12A2 and 13A2 to steer the ship 1.

The remote control device 11B is a device that receives an input operation for operating the propulsion unit 12A1 and has, for example, a remote control lever. The ship operator can change the magnitude and direction of the propulsion force generated by the propulsion unit 12A1 by operating the remote control device 11B. The remote control lever of the remote control device 11B can be located in a forward region in which the propulsion unit 12A1 generates a propulsion force in a forward direction for the ship 1, a backward region in which the propulsion unit 12A1 generates a propulsion force in a backward direction for the ship 1, and a neutral region in which the propulsion unit 12A1 does not generate a propulsion force. The magnitude of the propulsion force in the forward direction for the ship 1 which is generated by the propulsion unit 12A1 changes according to the position of the remote control lever in the forward region. Further, the magnitude of the propulsion force in the backward direction for the ship 1 which is generated by the propulsion unit 12A1 changes according to the position of the remote control lever in the backward region.

In the example shown in FIGS. 1 and FIG. 2, the remote control device 11C is a device that receives an input operation for operating the propulsion unit 13A1 and is configured in the same manner as the remote control device 11B. That is, the ship operator can change the magnitude and direction of the propulsion force generated by the propulsion unit 13A1 by operating the remote control device 11C.

The operation unit 11D is a device that operates the steering actuators 12A2 and 13A2 and the propulsion units 12A1 and 13A1. Specifically, the operation unit 11D receives an input operation for operating the steering actuators 12A2 and 13A2 and the propulsion units 12A1 and 13A1. The operation unit 11D is provided separately from the steering device 11A and the remote control devices 11B and 11C.

In the ship 1 of the first embodiment, the operation unit 11D is constituted by a joystick having a lever.

By operating the steering device 11A (the steering wheel) and the remote control devices 11B and 11C (the remote control lever), the ship operator can operate the steering actuators 12A2 and 13A2 and the propulsion units 12A1 and 13A1, and also by operating the operation unit 11D (the joystick), the ship operator can operate the steering actuators 12A2 and 13A2 and the propulsion units 12A1 and 13A1.

In the example shown in FIGS. 1 and FIG. 2, the control device 14 for an outboard motor controls the steering actuator 12A2 and the propulsion unit 12A1 of the outboard motor 12 and the steering actuator 13A2 and the propulsion unit 13A1 of the outboard motor 13 based on the input operation to the operation unit 11D. Specifically, the control device 14 for an outboard motor controls the magnitude and direction of the propulsion force for the ship 1 which is generated by the steering actuators 12A2 and 13A2 and the propulsion units 12A1 and 13A1 based on the input operation to the operation unit 11D.

The control device 14 for an outboard motor includes a movement route calculation unit 14A and a propulsion force calculation unit 14B. The movement route calculation unit 14A calculates a movement route of the operation unit 11D. Specifically, the movement route calculation unit 14A calculates the movement route of the tip end portion of the lever of the joystick based on the position of the lever of the joystick which is detected by, for example, a sensor (not shown) such as a micro switch.

The propulsion force calculation unit 14B calculates the propulsion force which the outboard motors 12 and 13 generate based on the movement route of the operation unit 11D which is calculated by the movement route calculation unit 14A. Specifically, the propulsion force calculation unit 14B calculates the magnitude and direction of the propulsion force of the ship 1 which the steering actuators 12A2 and 13A2 and the propulsion units 12A1 and 13A1 generate based on the movement route of the tip end portion of the lever of the joystick.

That is, the control device 14 for an outboard motor controls the steering actuators 12A2 and 13A2 and the propulsion units 12A1 and 13A1 such that the steering actuators 12A2 and 13A2 and the propulsion units 12A1 and 13A1 generate the propulsion force having the magnitude and direction calculated by the propulsion force calculation unit 14B.

In the example shown in FIGS. 1 and FIG. 2, the operation unit 11D is configured such that the lever of the operation unit 11D (the joystick) can be tilted and the lever can rotate about the central axis of the lever.

In a case in which the ship operator rotates the lever clockwise around the central axis of the lever, the control device 14 for an outboard motor controls the steering actuators 12A2 and 13A2 and the propulsion units 12A1 and 13A1 such that the ship hull 11 turns to the right. On the other hand, in a case in which the ship operator rotates the lever counterclockwise around the central axis of the lever, the control device 14 for an outboard motor controls the steering actuators 12A2 and 13A2 and the propulsion units 12A1 and 13A1 such that the ship hull 11 turns to the left. That is, when the ship operator rotates the lever around the central axis of the lever, the direction of a front portion of the ship hull 11 changes.

Further, in a case in which the ship operator tilts the lever, the control device 14 for an outboard motor controls the steering actuators 12A2 and 13A2 and the propulsion units 12A1 and 13A1 such that the ship hull 11 moves while maintaining its posture. That is, when the ship operator tilts the lever, the front portion of the ship hull 11 and a rear portion of the hull 11 are translated.

FIGS. 3A-FIG. 3I are diagrams for explaining an example of a position of the operation unit 11D (specifically, positions P1 to P9 of the tip end portion of the lever of the joystick) in the ship 1 of the first embodiment.

Figure 3A:
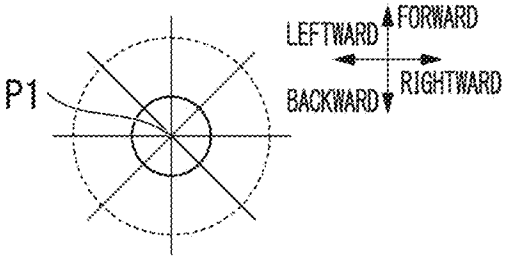
FIG. 3A-FIG. 3I are diagrams for explaining an example of a position of an operation unit in the ship of the first embodiment.

In the example shown in FIG. 3A, the lever of the operation unit 11D (the joystick) is not tilted. Therefore, the operation unit 11D (specifically, the tip end portion of the lever of the joystick) is located at the position (a neutral position) P1. In a case in which the operation unit 11D (the tip end portion of the lever of the joystick) is located at the position P1, the control device 14 for an outboard motor does not cause the steering actuators 12A2 and 13A2 and the propulsion units 12A1 and 13A1 to generate a propulsion force for the ship 1.

That is, the position P1 is a position at which the outboard motors 12 and 13 do not generate the propulsion force for the ship 1.

Figure 3B:
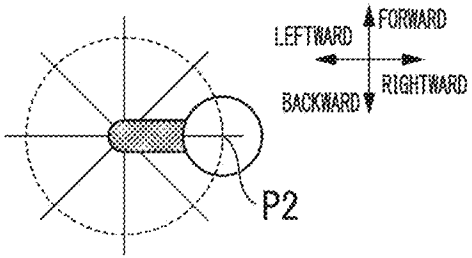

In the example shown in FIG. 3B, the lever of the joystick is tilted in a rightward direction. Therefore, the tip end portion of the lever of the joystick is located at the position P2 on a rightward side from the position P1. In a case in which the tip end portion of the lever of the joystick is located at the position P2, the control device 14 for an outboard motor causes the steering actuators 12A2 and 13A2 and the propulsion units 12A1 and 13A1 to generate a propulsion force for moving the ship 1 in the rightward direction.

That is, the position P2 is a position at which the outboard motors 12 and 13 generate a propulsion force for moving the ship 1 in the rightward direction (specifically, translational movement).

Figure 3C:
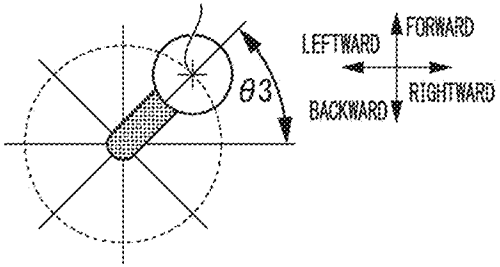

In the example shown in FIG. 3C, the lever of the joystick is tilted in a rightward-forward direction. Therefore, the tip end portion of the lever of the joystick is located at the position P3 on a rightward-forward side from the position P1. In a case in which the tip end portion of the lever of the joystick is located at the position P3, the control device 14 for an outboard motor causes the steering actuators 12A2 and 13A2 and the propulsion units 12A1 and 13A1 to generate a propulsion force for moving the ship 1 in the rightward-forward direction forming an acute angle θ3 with a leftward-rightward direction.

That is, the position P3 is a position at which the outboard motors 12 and 13 generate a propulsion force for moving the ship 1 in the rightward-forward direction (translational movement).

Figure 3D:
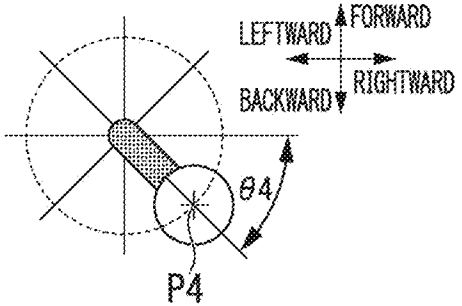

In the example shown in FIG. 3D, the lever of the joystick is tilted in a rightward-backward direction. Therefore, the tip end portion of the lever of the joystick is located at the position P4 on a rightward-backward side from the position P1. In a case in which the tip end portion of the lever of the joystick is located at the position P4, the control device 14 for an outboard motor causes the steering actuators 12A2 and 13A2 and the propulsion units 12A1 and 13A1 to generate a propulsion force for moving the ship 1 in the rightward-backward direction forming an acute angle θ4 with the leftward-rightward direction.

That is, the position P4 is a position at which the outboard motors 12 and 13 generate a propulsion force for moving the ship 1 in the rightward-backward direction (translational movement).

Figure 3E:
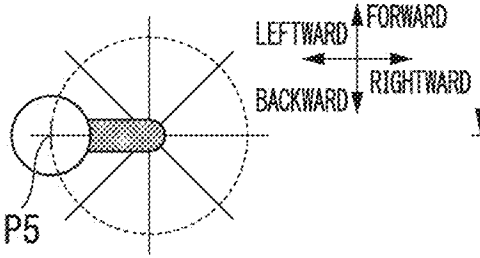

In the example shown in FIG. 3E, the lever of the joystick is tilted in a leftward direction. Therefore, the tip end portion of the lever of the joystick is located at the position P5 on a leftward side from the position P1. In a case in which the tip end portion of the lever of the joystick is located at the position P5, the control device 14 for an outboard motor causes the steering actuators 12A2 and 13A2 and the propulsion units 12A1 and 13A1 to generate a propulsion force for moving the ship 1 in the leftward direction.

That is, the position P5 is a position at which the outboard motors 12 and 13 generate a propulsion force for moving the ship 1 in the leftward direction (translational movement).

Figure 3F:
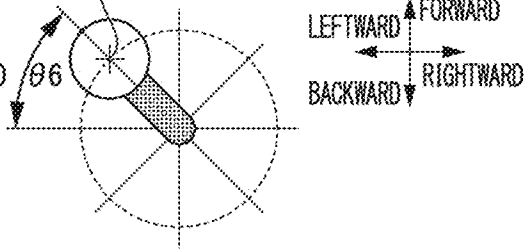

In the example shown in FIG. 3F, the lever of the joystick is tilted in a leftward-forward direction. Therefore, the tip end portion of the lever of the joystick is located at the position P6 on a leftward-forward side from the position P1. In a case in which the tip end portion of the lever of the joystick is located at the position P6, the control device 14 for an outboard motor causes the steering actuators 12A2 and 13A2 and the propulsion units 12A1 and 13A1 to generate a propulsion force for moving the ship 1 in the leftward-forward direction forming an acute angle θ6 with a leftward-rightward direction.

That is, the position P6 is a position at which the outboard motors 12 and 13 generate a propulsion force for moving the ship 1 in the leftward-forward direction (translational movement).

Figure 3G:
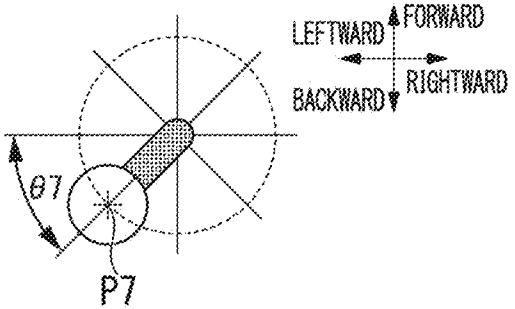

In the example shown in FIG. 3G, the lever of the joystick is tilted in a leftward-backward direction. Therefore, the tip end portion of the lever of the joystick is located at the position P7 on a leftward-backward side from the position P1. In a case in which the tip end portion of the lever of the joystick is located at the position P7, the control device 14 for an outboard motor causes the steering actuators 12A2 and 13A2 and the propulsion units 12A1 and 13A1 to generate a propulsion force for moving the ship 1 in the leftward-backward direction forming an acute angle θ7 with the leftward-rightward direction.

That is, the position P7 is a position at which the outboard motors 12 and 13 generate a propulsion force for moving the ship 1 in the leftward-backward direction (translational movement).

Figure 3H:
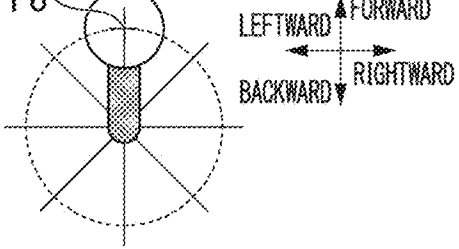

In the example shown in FIG. 3H, the lever of the joystick is tilted in a forward direction. Therefore, the tip end portion of the lever of the joystick is located at the position P8 on a front side from the position P1. In a case in which the tip end portion of the lever of the joystick is located at the position P8, the control device 14 for an outboard motor causes the steering actuators 12A2 and 13A2 and the propulsion units 12A1 and 13A1 to generate a propulsion force for moving the ship 1 in the forward direction.

That is, the position P8 is a position at which the outboard motors 12 and 13 generate a propulsion force for moving the ship 1 in the forward direction (forward movement).

Figure 3I:
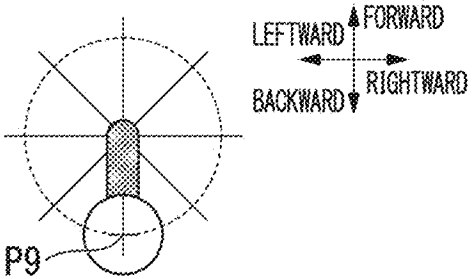

In the example shown in FIG. 3I, the lever of the joystick is tilted in a backward direction. Therefore, the tip end portion of the lever of the joystick is located at the position P9 on a backward side from the position P1. In a case in which the tip end portion of the lever of the joystick is located at the position P9, the control device 14 for an outboard motor causes the steering actuators 12A2 and 13A2 and the propulsion units 12A1 and 13A1 to generate a propulsion force for moving the ship 1 in the backward direction.

That is, the position P9 is a position at which the outboard motors 12 and 13 generate a propulsion force for moving the ship 1 in the backward direction (backward movement).

In a case in which the ship operator does not operate the operation unit 11D (the joystick), the tip end portion of the lever of the joystick having an automatic return function is located at the position P1. The tip end portion of the lever of the joystick can be located at, for example, a position such as the positions P1 to P9 according to the operation of the ship operator.

FIG. 4A-FIGS. 4E and 5 are diagrams for explaining an example of a movement route of the operation unit 11D (specifically, a movement route of the tip end portion of the lever of the joystick) in the ship 1 of the first embodiment.

Figure 4A:
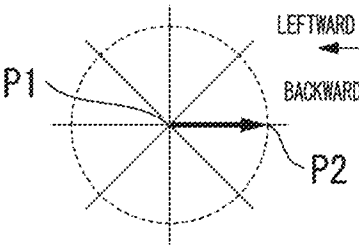
FIGS. 4A-FIG. 4D are diagrams for explaining an example of a movement route of the operation unit in the ship of the first embodiment.

In the example shown in FIG. 4A, the operation unit 11D (specifically, the tip end portion of the lever of the joystick) is moved from the position P1 to the position P2.

The movement route calculation unit 14A calculates a movement route P1→P2 of the tip end portion of the lever of the joystick based on the position of the lever when the tip end portion of the lever of the joystick is located at the position P1 and the position of the lever when the tip end portion of the lever of the joystick is located at the position P2.

The propulsion force calculation unit 14B calculates the propulsion force which the outboard motors 12 and 13 generate based on the movement route P1→P2 of the tip end portion of the lever of the joystick which is calculated by the movement route calculation unit 14A. Specifically, the propulsion force calculation unit 14B calculates the magnitude of the propulsion force for moving the ship 1 in the rightward direction.

The control device 14 for an outboard motor causes the steering actuators 12A2 and 13A2 and the propulsion units 12A1 and 13A1 to generate the propulsion force in the rightward direction which has the magnitude calculated by the propulsion force calculation unit 14B.

As a result, the ship 1 moves in the rightward direction (translational movement).

The ship operator may want to move the ship 1 in the rightward-forward direction (translational movement).

Figure 4B:
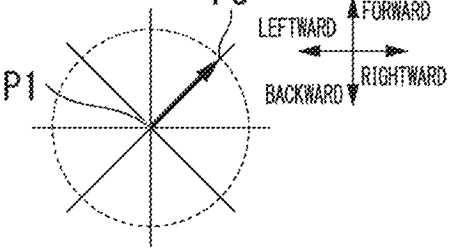

In such a case, as in the example shown in FIG. 4B, the operation unit 11D (the tip end portion of the lever of the joystick) is moved from the position P1 to the position P3.

The movement route calculation unit 14A calculates a movement route P1→P3 of the tip end portion of the lever of the joystick based on the position of the lever when the tip end portion of the lever of the joystick is located at the position P1 and the position of the lever when the tip end portion of the lever of the joystick is located at the position P3.

The propulsion force calculation unit 14B calculates the propulsion force which the outboard motors 12 and 13 generate based on the movement route P1→P3 of the tip end portion of the lever of the joystick which is calculated by the movement route calculation unit 14A. Specifically, the propulsion force calculation unit 14B calculates the magnitude of the propulsion force for moving the ship 1 in the rightward-forward direction.

The control device 14 for an outboard motor causes the steering actuators 12A2 and 13A2 and the propulsion units 12A1 and 13A1 to generate the propulsion force in the rightward-forward direction which has the magnitude calculated by the propulsion force calculation unit 14B.

As a result, the ship 1 moves in the rightward-forward direction (translational movement).

In a case in which the ship operator wants to move the ship 1 in the rightward direction (translational movement), the ship 1 may receive a force in a backward direction due to, for example, wind, tidal current, and the like.

Figure 4C:
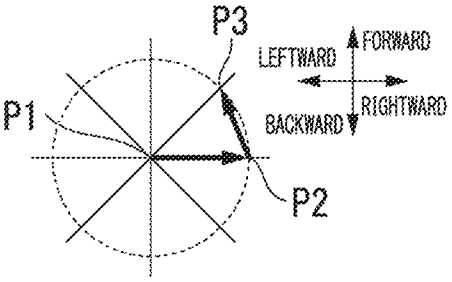

In such a case, as in the example shown in FIG. 4C, first, the operation unit 11D (the tip end portion of the lever of the joystick) is moved from the position P1 to the position P2. Since the ship 1 is likely to be swept in the backward direction by the force in the backward direction due to wind, tidal current, and the like, the operation unit 11D (the tip end portion of lever of the joystick) is then moved from the position P2 to the position P3.

That is, in the example shown in FIG. 4C, the operation unit 11D (the tip end portion of the lever of the joystick) is moved from the position P1 to the position P3 via the position P2.

The movement route calculation unit 14A calculates a movement route P1→P2→P3 of the tip end portion of the lever of the joystick based on the position of the lever when the tip end portion of the lever of the joystick is located at the position P1, the position of the lever when the tip end portion of the lever of the joystick is located at the position P2, and the position of the lever when the tip end portion of the lever of the joystick is located at the position P3.

The propulsion force calculation unit 14B calculates the propulsion force which the outboard motors 12 and 13 generate based on the movement route P1→P2→P3 of the tip end portion of the lever of the joystick which is calculated by the movement route calculation unit 14A. Specifically, the propulsion force calculation unit 14B calculates the magnitude of the propulsion force (that is, the propulsion force in the rightward-forward direction) for moving the ship 1 in the rightward direction against the force in the backward direction due to, for example, wind, tidal current, and the like.

The control device 14 for an outboard motor causes the steering actuators 12A2 and 13A2 and the propulsion units 12A1 and 13A1 to generate the propulsion force in the rightward-forward direction which has the magnitude calculated by the propulsion force calculation unit 14B.

Through diligent research, the present inventors have found that, in a case in which the magnitude of the forward-backward direction component of the propulsion force in the rightward-forward direction which is generated by the outboard motors 12 and 13 when the operation unit 11D (the tip end portion of the lever of the joystick) is moved from the position P1 to the position P3 via the position P2 (the example shown in (C) of FIG. 4) and the magnitude of the forward-backward direction component of the propulsion force in the rightward-forward direction which is generated by the outboard motors 12 and 13 when the operation unit 11D (the tip end portion of the lever of the joystick) is moved directly from the position P1 to the position P3 (the example shown in (B) of FIG. 4) are set to be equal to each other, the magnitude of the forward-backward direction component of the propulsion force against the force in the backward direction due to, for example, wind, tidal current, and the like is not sufficient and the ship 1 may be swept in the backward direction without being moved in the rightward direction (translational movement) as desired by the ship operator.

Therefore, in the example shown in FIG. 4C, the control device 14 for an outboard motor causes the steering actuators 12A2 and 13A2 and the propulsion units 12A1 and 13A1 to generate the propulsion force in the rightward-forward direction which has the forward-backward direction component (specifically, a forward direction component) larger than that in the example shown in FIG. 4B.

As a result, the ship 1 moves in the rightward direction (translational movement) according to the desire of the ship operator and against the force in the backward direction due to, for example, wind, tidal current, and the like.

FIGS. 6A-FIG. 6D is a diagram showing a propulsion force in a rightward-forward direction which the control device 14 for an outboard motor causes the outboard motors 12 and 13 to generate in the example shown in FIG. 4B, a propulsion force in a rightward-forward direction which the control device 14 for an outboard motor causes the outboard motors 12 and 13 to generate in the example shown in FIG. 4C, and the like for comparison.

Figure 6A:
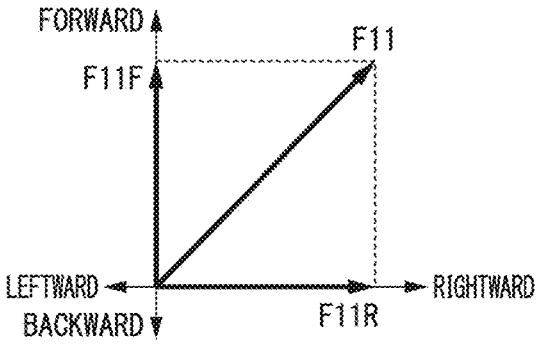
FIGS. 6A-FIG. 6D are diagrams showing a propulsion force in a rightward-forward direction which the control device for an outboard motor causes the outboard motor to generate in the example shown in FIG. 4B, a propulsion force in a rightward-forward direction which the control device for an outboard motor causes the outboard motor to generate in the example shown in FIG. 4C, and the like for comparison.

(FIG. 6A shows a propulsion force F11 in a rightward-forward direction which the control device 14 for an outboard motor causes the outboard motors 12 and 13 to generate (that is, which is calculated by the propulsion force calculation unit 14B), a forward-backward direction component F11F thereof, and a leftward-rightward direction component F11R thereof in a case in which the operation unit 11D (the tip end portion of the lever of the joystick) is moved directly from the position P1 to the position P3 (in the example shown in FIG. 4B).

Figure 6B:
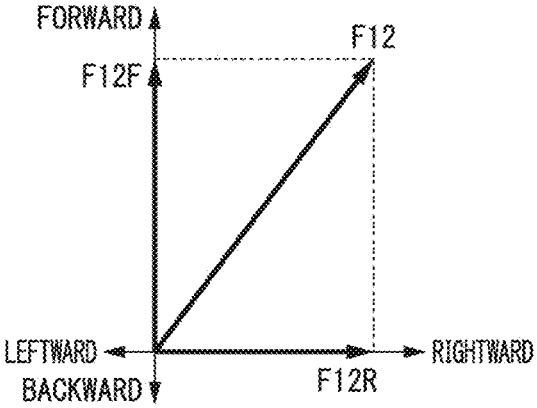

FIG. 6B shows a propulsion force F12 in a rightward-forward direction which the control device 14 for an outboard motor causes the outboard motors 12 and 13 to generate (that is, which is calculated by the propulsion force calculation unit 14B), a forward-backward direction component F12F thereof, and a leftward-rightward direction component F12R thereof in a case in which the operation unit 11D (the tip end portion of the lever of the joystick) is moved from the position P1 to the position P3 via the position P2 (in the example shown in FIG. 4C).

In the examples shown in FIG. 6A and FIG. 6B, the magnitude of the leftward-rightward direction component F11R of the propulsion force F11 in the rightward-forward direction and the magnitude of the leftward-rightward direction component F12R of the propulsion force F12 in the rightward-forward direction are set to be equal to each other. Further, the forward-backward direction component F12F of the propulsion force F12 in the rightward-forward direction is set to be larger than the forward-backward direction component F11F of the propulsion force F11 in the rightward-forward direction. As a result, the propulsion force F12 in the rightward-forward direction is also larger than the propulsion force F11 in the rightward-forward direction.

Therefore, in the examples shown in FIG. 6A and FIG. 6B, even in a case in which the ship 1 receives the force in the backward direction during a period in which the ship 1 is moved in the rightward direction by the ship operator moving the operation unit 11D (the tip end portion of the lever of the joystick) from the position P1 to the position P2, the ship operator moves the operation unit 11D (the tip end portion of the lever of the joystick) from the position P2 to the position P3, and thus the outboard motors 12 and 13 generate the propulsion force F12 in the rightward-forward direction which has the larger forward-backward direction component F12F. As a result, the ship operator can move the ship 1 in the rightward direction without the ship 1 being swept in the backward direction.

In the examples shown in FIG. 6A and FIG. 6B, as described above, the magnitude of the leftward-rightward direction component F11R of the propulsion force F11 in the rightward-forward direction and the magnitude of the leftward-rightward direction component F12R of the propulsion force F12 in the rightward-forward direction are set to be equal to each other. Further, the forward-backward direction component F12F of the propulsion force F12 in the rightward-forward direction is set to be larger than the forward-backward direction component F11F of the propulsion force F11 in the rightward-forward direction.

In another example, the magnitude of the forward-backward direction component F12F of the propulsion force F12 in the rightward-forward direction and the magnitude of the forward-backward direction component F11F of the propulsion force F11 in the rightward-forward direction are set to be equal to each other, and the leftward-rightward direction component F12R of the propulsion force F12 in the rightward-forward direction is set smaller than the leftward-rightward direction component F11R of the propulsion force F11 in the rightward-forward direction. That is, in this example, the propulsion force F12 in the rightward-forward direction is smaller than the propulsion force F11 in the rightward-forward direction.

Therefore, in this example, even in a case in which the ship 1 receives the force in the backward direction during a period in which the ship 1 is moved in the rightward direction by the ship operator moving the operation unit 11D (the tip end portion of the lever of the joystick) from the position P1 to the position P2, the ship operator moves the operation unit 11D (the tip end portion of the lever of the joystick) from the position P2 to the position P3, and thus the outboard motors 12 and 13 generate the propulsion force F12 in the rightward-forward direction which has the smaller leftward-rightward direction component F12R. As a result, also in this example, the ship operator can move the ship 1 in the rightward direction without the ship 1 being swept in the backward direction.

For example, when the ship does not receive a force in a forward-backward direction due to wind, tidal current, and the like, the ship operator may switch (correct) the direction of the ship 1 moving in the rightward direction (translational movement) from the rightward direction to the rightward-forward direction.

In such a case, as in the example shown in FIG. 4C, first, the operation unit 11D (the tip end portion of the lever of the joystick) is moved from the position P1 to the position P2. To switch the direction of the ship 1 moving in the rightward direction from the rightward direction to the rightward-forward direction, the operation unit 11D (the tip end portion of the lever of the joystick) is then moved from the position P2 to the position P3.

That is, in the example shown in FIG. 4C, the operation unit 11D (the tip end portion of the lever of the joystick) is moved from the position P1 to the position P3 via the position P2.

The movement route calculation unit 14A calculates a movement route P1→P2→P3 of the tip end portion of the lever of the joystick based on the position of the lever when the tip end portion of the lever of the joystick is located at the position P1, the position of the lever when the tip end portion of the lever of the joystick is located at the position P2, and the position of the lever when the tip end portion of the lever of the joystick is located at the position P3.

The propulsion force calculation unit 14B calculates the propulsion force which the outboard motors 12 and 13 generate based on the movement route P1→P2→P3 of the tip end portion of the lever of the joystick which is calculated by the movement route calculation unit 14A. Specifically, the propulsion force calculation unit 14B calculates the magnitude of the propulsion force for switching the direction of the ship 1 moving in the rightward direction from the rightward direction to the rightward-forward direction (that is, the propulsion force in the rightward-forward direction).

The control device 14 for an outboard motor causes the steering actuators 12A2 and 13A2 and the propulsion units 12A1 and 13A1 to generate the propulsion force in the rightward-forward direction which has the magnitude calculated by the propulsion force calculation unit 14B.

Through diligent research, the present inventors have found that, since an inertial force in the rightward direction is generated in the ship 1 moving in the rightward direction, in a case in which the magnitude of the forward-backward direction component of the propulsion force in the rightward-forward direction which is generated by the outboard motors 12 and 13 when the operation unit 11D (the tip end portion of the lever of the joystick) is moved from the position P1 to the position P3 via the position P2 (the example shown in FIG. 4*c*) and the magnitude of the forward-backward direction component of the propulsion force in the rightward-forward direction which is generated by the outboard motors 12 and 13 when the operation unit 11D (the tip end portion of the lever of the joystick) is moved directly from the position P1 to the position P3 (the example shown in FIG. 4B) are set to be equal to each other, the ship operator may feel that a response operation of the ship 1 to the correction operation of the ship operator is slow (that is, the switching of the direction of the ship 1 from the rightward direction to the rightward-forward direction is slow).

Therefore, in the example shown in FIG. 4C, the control device 14 for an outboard motor causes the steering actuators 12A2 and 13A2 and the propulsion units 12A1 and 13A1 to generate the propulsion force F12 in the rightward-forward direction in which the forward-backward direction component is larger than that in the example shown in FIG. 4B (specifically, the forward direction component F12F is larger than the forward direction component F11F). As a result, the direction of the ship 1 can be quickly switched from the rightward direction to the rightward-forward direction according to the desire of the ship operator.

In another example, the control device 14 for an outboard motor causes the steering actuators 12A2 and 13A2 and the propulsion units 12A1 and 13A1 to generate the propulsion force F12 in the rightward-forward direction in which the leftward-rightward direction component is smaller than that in the example shown in FIG. 4B (specifically, the forward direction component F12F and the forward direction component F11F are equal to each other, and the rightward direction component F12R is smaller than the rightward direction component F11R). As a result, also in this example, the direction of the ship 1 can be quickly switched from the rightward direction to the rightward-forward direction according to the desire of the ship operator.

Further, the ship operator may want to move the ship 1 in the rightward-backward direction (translational movement).

Figure 4D:
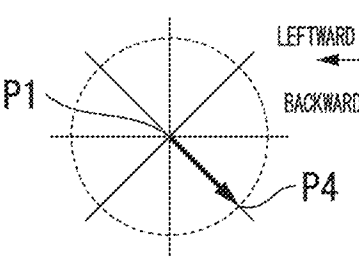

In such a case, as in the example shown in FIG. 4D, the operation unit 11D (the tip end portion of the lever of the joystick) is moved from the position P1 to the position P4.

The movement route calculation unit 14A calculates a movement route P1→P4 of the tip end portion of the lever of the joystick based on the position of the lever when the tip end portion of the lever of the joystick is located at the position P1 and the position of the lever when the tip end portion of the lever of the joystick is located at the position P4.

The propulsion force calculation unit 14B calculates the propulsion force which the outboard motors 12 and 13 generate based on the movement route P1→P4 of the tip end portion of the lever of the joystick which is calculated by the movement route calculation unit 14A. Specifically, the propulsion force calculation unit 14B calculates the magnitude of the propulsion force for moving the ship 1 in the rightward-backward direction.

The control device 14 for an outboard motor causes the steering actuators 12A2 and 13A2 and the propulsion units 12A1 and 13A1 to generate the propulsion force in the rightward-backward direction which has the magnitude calculated by the propulsion force calculation unit 14B.

As a result, the ship 1 moves in the rightward-backward direction (translational movement).

In a case in which the ship operator wants to move the ship 1 in the rightward direction (translational movement), the ship 1 may receive a force in a forward direction due to, for example, wind, tidal current, and the like.

Figure 4E:
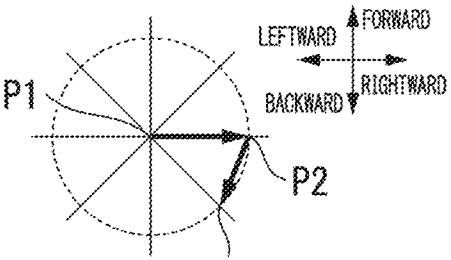

In such a case, as in the example shown in FIG. 4E, first, the operation unit 11D (the tip end portion of the lever of the joystick) is moved from the position P1 to the position P2. Since the ship 1 is likely to be swept in the forward direction by the force in the forward direction due to wind, tidal current, and the like, the operation unit 11D (the tip end portion of lever of the joystick) is then moved from the position P2 to the position P4.

That is, in the example shown in FIG. 4E, the operation unit 11D (the tip end portion of the lever of the joystick) is moved from the position P1 to the position P4 via the position P2.

The movement route calculation unit 14A calculates a movement route P1→P2→P4 of the tip end portion of the lever of the joystick based on the position of the lever when the tip end portion of the lever of the joystick is located at the position P1, the position of the lever when the tip end portion of the lever of the joystick is located at the position P2, and the position of the lever when the tip end portion of the lever of the joystick is located at the position P4.

The propulsion force calculation unit 14B calculates the propulsion force which the outboard motors 12 and 13 generate based on the movement route P1→P2→P4 of the tip end portion of the lever of the joystick which is calculated by the movement route calculation unit 14A. Specifically, the propulsion force calculation unit 14B calculates the magnitude of the propulsion force (that is, the propulsion force in the rightward-backward direction) for moving the ship 1 in the rightward direction against the force in the forward direction due to, for example, wind, tidal current, and the like.

The control device 14 for an outboard motor causes the steering actuators 12A2 and 13A2 and the propulsion units 12A1 and 13A1 to generate the propulsion force in the rightward-backward direction which has the magnitude calculated by the propulsion force calculation unit 14B.

In the example shown in FIG. 4E, the control device 14 for an outboard motor causes the steering actuators 12A2 and 13A2 and the propulsion units 12A1 and 13A1 to generate the propulsion force in the rightward-backward direction which has the forward-backward direction component (specifically, a backward direction component) larger than that in the example shown in FIG. 4D.

As a result, the ship 1 moves in the rightward direction (translational movement) according to the desire of the ship operator and against the force in the forward direction due to, for example, wind, tidal current, and the like.

Figure 6C:
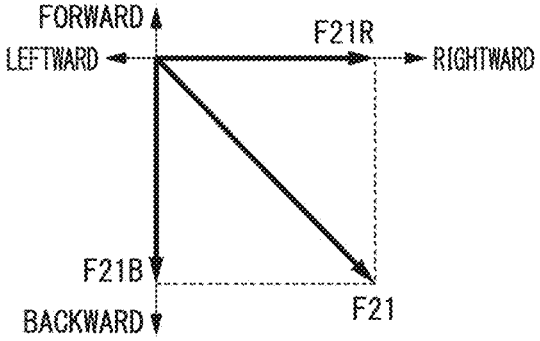

FIG. 6C shows a propulsion force F21 in a rightward-backward direction which the control device 14 for an outboard motor causes the outboard motors 12 and 13 to generate (that is, which is calculated by the propulsion force calculation unit 14B), a forward-backward direction component F21B thereof, and a leftward-rightward direction component F21R thereof in a case in which the operation unit 11D (the tip end portion of the lever of the joystick) is moved directly from the position P1 to the position P4 (in the example shown in FIG. 4D).

Figure 6D:
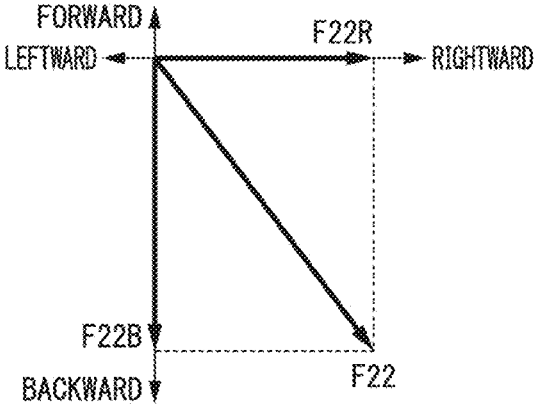

FIG. 6D shows a propulsion force F22 in a rightward-backward direction which the control device 14 for an outboard motor causes the outboard motors 12 and 13 to generate (that is, which is calculated by the propulsion force calculation unit 14B), a forward-backward direction component F22B thereof, and a leftward-rightward direction component F22R thereof in a case in which the operation unit 11D (the tip end portion of the lever of the joystick) is moved from the position P1 to the position P4 via the position P2 (in the example shown in FIG. 4E).

In the examples shown in FIG. 6C and FIG. 6D, the magnitude of the leftward-rightward direction component F21R of the propulsion force F21 in the rightward-backward direction and the magnitude of the leftward-rightward direction component F22R of the propulsion force F22 in the rightward-backward direction are set to be equal to each other. Further, the forward-backward direction component F22B of the propulsion force F22 in the rightward-backward direction is set to be larger than the forward-backward direction component F21B of the propulsion force F21 in the rightward-backward direction. As a result, the propulsion force F22 in the rightward-backward direction is also larger than the propulsion force F21 in the rightward-backward direction.

Therefore, in the examples shown in FIG. 6C and FIG. 6D, even in a case in which the ship 1 receives the force in the forward direction during a period in which the ship 1 is moved in the rightward direction by the ship operator moving the operation unit 11D (the tip end portion of the lever of the joystick) from the position P1 to the position P2, the ship operator moves the operation unit 11D (the tip end portion of the lever of the joystick) from the position P2 to the position P4, and thus the outboard motors 12 and 13 generate the propulsion force F22 in the rightward-backward direction which has the larger forward-backward direction component F22B. As a result, the ship operator can move the ship 1 in the rightward direction without the ship 1 being swept in the forward direction.

In the examples shown in FIG. 6C and FIG. 6D, as described above, the magnitude of the leftward-rightward direction component F21R of the propulsion force F21 in the rightward-backward direction and the magnitude of the leftward-rightward direction component F22R of the propulsion force F22 in the rightward-backward direction are set to be equal to each other. Further, the forward-backward direction component F22B of the propulsion force F22 in the rightward-backward direction is set to be larger than the forward-backward direction component F21B of the propulsion force F21 in the rightward-backward direction.

In another example, the magnitude of the forward-backward direction component F22B of the propulsion force F22 in the rightward-backward direction and the magnitude of the forward-backward direction component F21B of the propulsion force F21 in the rightward-backward direction are set to be equal to each other, and the leftward-rightward direction component F22R of the propulsion force F22 in the rightward-backward direction is set smaller than the leftward-rightward direction component F21R of the propulsion force F21 in the rightward-backward direction. That is, in this example, the propulsion force F22 in the rightward-backward direction is smaller than the propulsion force F21 in the rightward-backward direction.

Therefore, in this example, even in a case in which the ship 1 receives the force in the forward direction during a period in which the ship 1 is moved in the rightward direction by the ship operator moving the operation unit 11D (the tip end portion of the lever of the joystick) from the position P1 to the position P2, the ship operator moves the operation unit 11D (the tip end portion of the lever of the joystick) from the position P2 to the position P4, and thus the outboard motors 12 and 13 generate the propulsion force F22 in the rightward-backward direction which has the smaller leftward-rightward direction component F22R. As a result, also in this example, the ship operator can move the ship 1 in the rightward direction without the ship 1 being swept in the forward direction.

For example, when the ship does not receive a force in the forward-backward direction due to wind, tidal current, and the like, the ship operator may switch (correct) the direction of the ship 1 moving in the rightward direction (translational movement) from the rightward direction to the rightward-backward direction.

In such a case, as in the example shown in FIG. 4E, first, the operation unit 11D (the tip end portion of the lever of the joystick) is moved from the position P1 to the position P2. To switch the direction of the ship 1 moving in the rightward direction from the rightward direction to the rightward-backward direction, the operation unit 11D (the tip end portion of the lever of the joystick) is then moved from the position P2 to the position P4.

That is, in the example shown in FIG. 4E, the operation unit 11D (the tip end portion of the lever of the joystick) is moved from the position P1 to the position P4 via the position P2.

The movement route calculation unit 14A calculates a movement route P1→P2→P4 of the tip end portion of the lever of the joystick based on the position of the lever when the tip end portion of the lever of the joystick is located at the position P1, the position of the lever when the tip end portion of the lever of the joystick is located at the position P2, and the position of the lever when the tip end portion of the lever of the joystick is located at the position P4.

The propulsion force calculation unit 14B calculates the propulsion force which the outboard motors 12 and 13 generate based on the movement route P1→P2→P4 of the tip end portion of the lever of the joystick which is calculated by the movement route calculation unit 14A. Specifically, the propulsion force calculation unit 14B calculates the magnitude of the propulsion force for switching the direction of the ship 1 moving in the rightward direction from the rightward direction to the rightward-backward direction (that is, the propulsion force in the rightward-backward direction).

The control device 14 for an outboard motor causes the steering actuators 12A2 and 13A2 and the propulsion units 12A1 and 13A1 to generate the propulsion force in the rightward-backward direction which has the magnitude calculated by the propulsion force calculation unit 14B.

In the example shown in FIG. 4E, the control device 14 for an outboard motor causes the steering actuators 12A2 and 13A2 and the propulsion units 12A1 and 13A1 to generate the propulsion force F22 in the rightward-backward direction in which the forward-backward direction component is larger than that in the example shown in FIG. 4D (specifically, the backward direction component F22B is larger than the backward direction component F21B). As a result, the direction of the ship 1 can be quickly switched from the rightward direction to the rightward-backward direction according to the desire of the ship operator.

In another example, the control device 14 for an outboard motor causes the steering actuators 12A2 and 13A2 and the propulsion units 12A1 and 13A1 to generate the propulsion force F22 in the rightward-backward direction in which the leftward-rightward direction component is smaller than that in the example shown in (D) of FIG. 4D (specifically, the backward direction component F22B and the backward direction component F21B are equal to each other, and the rightward direction component F22R is smaller than the rightward direction component F21R). As a result, also in this example, the direction of the ship 1 can be quickly switched from the rightward direction to the rightward-backward direction according to the desire of the ship operator.

The ship operator may want to move the ship 1 in the leftward direction (translational movement).

Figure 5A:
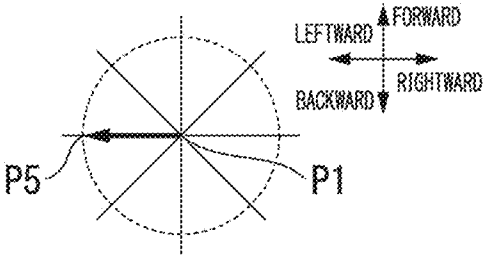
FIGS. 5A-FIG. 5E are diagrams for explaining an example of a movement route of the operation unit in the ship of the first embodiment.

In such a case, as in the example shown in FIG. 5A, the operation unit 11D (specifically, the tip end portion of the lever of the joystick) is moved from the position P1 to the position P5.

The movement route calculation unit 14A calculates a movement route P1→P5 of the tip end portion of the lever of the joystick based on the position of the lever when the tip end portion of the lever of the joystick is located at the position P1 and the position of the lever when the tip end portion of the lever of the joystick is located at the position P5.

The propulsion force calculation unit 14B calculates the propulsion force which the outboard motors 12 and 13 generate based on the movement route P1→P5 of the tip end portion of the lever of the joystick which is calculated by the movement route calculation unit 14A. Specifically, the propulsion force calculation unit 14B calculates the magnitude of the propulsion force for moving the ship 1 in the leftward direction.

The control device 14 for an outboard motor causes the steering actuators 12A2 and 13A2 and the propulsion units 12A1 and 13A1 to generate the propulsion force in the leftward direction which has the magnitude calculated by the propulsion force calculation unit 14B.

As a result, the ship 1 moves in the leftward direction (translational movement).

The ship operator may want to move the ship 1 in the leftward-forward direction (translational movement).

Figure 5B:
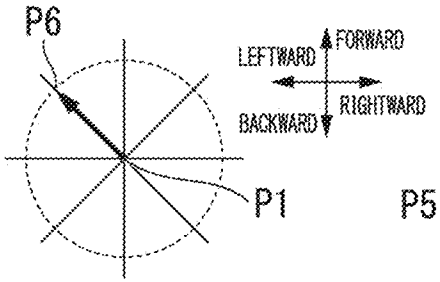

In such a case, as in the example shown FIG. 5B, the operation unit 11D (the tip end portion of the lever of the joystick) is moved from the position P1 to the position P6.

The movement route calculation unit 14A calculates a movement route P1→P6 of the tip end portion of the lever of the joystick based on the position of the lever when the tip end portion of the lever of the joystick is located at the position P1 and the position of the lever when the tip end portion of the lever of the joystick is located at the position P6.

The propulsion force calculation unit 14B calculates the propulsion force which the outboard motors 12 and 13 generate based on the movement route P1→P6 of the tip end portion of the lever of the joystick which is calculated by the movement route calculation unit 14A. Specifically, the propulsion force calculation unit 14B calculates the magnitude of the propulsion force for moving the ship 1 in the leftward-forward direction.

The control device 14 for an outboard motor causes the steering actuators 12A2 and 13A2 and the propulsion units 12A1 and 13A1 to generate the propulsion force in the leftward-forward direction which has the magnitude calculated by the propulsion force calculation unit 14B.

As a result, the ship 1 moves in the leftward-forward direction (translational movement).

In a case in which the ship operator wants to move the ship 1 in the leftward direction (translational movement), the ship 1 may receive a force in a backward direction due to, for example, wind, tidal current, and the like.

Figure 5C:
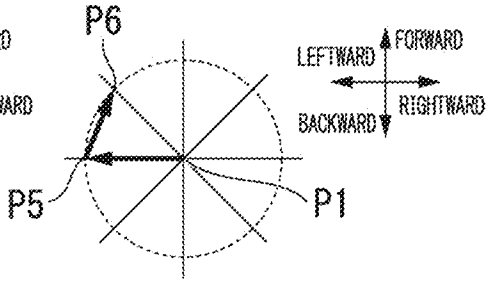

In such a case, as in the example shown in FIG. 5C, first, the operation unit 11D (the tip end portion of the lever of the joystick) is moved from the position P1 to the position P5. Since the ship 1 is likely to be swept in the backward direction by the force in the backward direction due to wind, tidal current, and the like, the operation unit 11D (the tip end portion of lever of the joystick) is then moved from the position P5 to the position P6.

That is, in the example shown in FIG. 5C, the operation unit 11D (the tip end portion of the lever of the joystick) is moved from the position P1 to the position P6 via the position P5.

The movement route calculation unit 14A calculates a movement route P1→P5→P6 of the tip end portion of the lever of the joystick based on the position of the lever when the tip end portion of the lever of the joystick is located at the position P1, the position of the lever when the tip end portion of the lever of the joystick is located at the position P5, and the position of the lever when the tip end portion of the lever of the joystick is located at the position P6.

The propulsion force calculation unit 14B calculates the propulsion force which the outboard motors 12 and 13 generate based on the movement route P1→P5→P6 of the tip end portion of the lever of the joystick which is calculated by the movement route calculation unit 14A. Specifically, the propulsion force calculation unit 14B calculates the magnitude of the propulsion force (that is, the propulsion force in the leftward-forward direction) for moving the ship 1 in the leftward direction against the force in the backward direction due to, for example, wind, tidal current, and the like.

The control device 14 for an outboard motor causes the steering actuators 12A2 and 13A2 and the propulsion units 12A1 and 13A1 to generate the propulsion force in the leftward-forward direction which has the magnitude calculated by the propulsion force calculation unit 14B.

In the example shown in FIG. 5C, the control device 14 for an outboard motor causes the steering actuators 12A2 and 13A2 and the propulsion units 12A1 and 13A1 to generate the propulsion force in the leftward-forward direction which has the forward-backward direction component (specifically, a forward direction component) larger than that in the example shown in FIG. 5B.

As a result, the ship 1 moves in the leftward direction (translational movement) according to the desire of the ship operator and against the force in the backward direction due to, for example, wind, tidal current, and the like.

FIGS. 7A-FIG. 7D is a diagram showing a propulsion force in a leftward-forward direction which the control device 14 for an outboard motor causes the outboard motors 12 and 13 to generate in the example shown in FIG. 5B, a propulsion force in a leftward-forward direction which the control device 14 for an outboard motor causes the outboard motors 12 and 13 to generate in the example shown in (C) of FIG. 5, and the like for comparison.

Figure 7A:
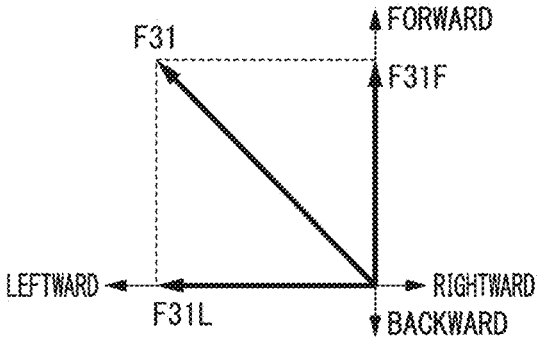
FIG. 7A-FIG. 7D are diagrams showing a propulsion force in a leftward-forward direction which the control device for an outboard motor causes the outboard motor to generate in the example shown in FIG. 5B, a propulsion force in a leftward-forward direction which the control device for an outboard motor causes the outboard motor to generate in the example shown in FIG. 5C, and the like for comparison.

FIG. 7A shows a propulsion force F31 in a leftward-forward direction which the control device 14 for an outboard motor causes the outboard motors 12 and 13 to generate (that is, which is calculated by the propulsion force calculation unit 14B), a forward-backward direction component F31F thereof, and a leftward-rightward direction component F31L thereof in a case in which the operation unit 11D (the tip end portion of the lever of the joystick) is moved directly from the position P1 to the position P6 (in the example shown in FIG. 5B).

Figure 7B:
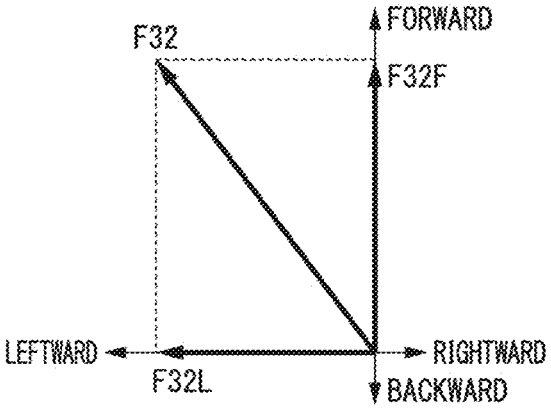

FIG. 7B shows a propulsion force F32 in a leftward-forward direction which the control device 14 for an outboard motor causes the outboard motors 12 and 13 to generate (that is, which is calculated by the propulsion force calculation unit 14B), a forward-backward direction component F32F thereof, and a leftward-rightward direction component F32L thereof in a case in which the operation unit 11D (the tip end portion of the lever of the joystick) is moved from the position P1 to the position P6 via the position P5 (in the example shown in FIG. 5C).

In the examples shown in FIG. 7A and FIG. 7B, the magnitude of the leftward-rightward direction component F31L of the propulsion force F31 in the leftward-forward direction and the magnitude of the leftward-rightward direction component F32L of the propulsion force F32 in the leftward-forward direction are set to be equal to each other. Further, the forward-backward direction component F32F of the propulsion force F32 in the leftward-forward direction is set to be larger than the forward-backward direction component F31F of the propulsion force F31 in the leftward-forward direction. As a result, the propulsion force F32 in the leftward-forward direction is also larger than the propulsion force F31 in the leftward-forward direction.

Therefore, in the examples shown in FIG. 7A and FIG. 7B, even in a case in which the ship 1 receives the force in the backward direction during a period in which the ship 1 is moved in the leftward direction by the ship operator moving the operation unit 11D (the tip end portion of the lever of the joystick) from the position P1 to the position P5, the ship operator moves the operation unit 11D (the tip end portion of the lever of the joystick) from the position P5 to the position P6, and thus the outboard motors 12 and 13 generate the propulsion force F32 in the leftward-forward direction which has the larger forward-backward direction component F32F. As a result, the ship operator can move the ship 1 in the leftward direction without the ship 1 being swept in the backward direction.

In the examples shown in FIG. 7A and FIG. 7B, as described above, the magnitude of the leftward-rightward direction component F31L of the propulsion force F31 in the leftward-forward direction and the magnitude of the leftward-rightward direction component F32L of the propulsion force F32 in the leftward-forward direction are set to be equal to each other. Further, the forward-backward direction component F32F of the propulsion force F32 in the leftward-forward direction is set to be larger than the forward-backward direction component F31F of the propulsion force F31 in the leftward-forward direction.

In another example, the magnitude of the forward-backward direction component F32F of the propulsion force F32 in the leftward-forward direction and the magnitude of the forward-backward direction component F31F of the propulsion force F31 in the leftward-forward direction are set to be equal to each other, and the leftward-rightward direction component F32L of the propulsion force F32 in the leftward-forward direction is set smaller than the leftward-rightward direction component F31L of the propulsion force F31 in the leftward-forward direction. That is, in this example, the propulsion force F32 in the leftward-forward direction is smaller than the propulsion force F31 in the leftward-forward direction.

Therefore, in this example, even in a case in which the ship 1 receives the force in the backward direction during a period in which the ship 1 is moved in the leftward direction by the ship operator moving the operation unit 11D (the tip end portion of the lever of the joystick) from the position P1 to the position P5, the ship operator moves the operation unit 11D (the tip end portion of the lever of the joystick) from the position P5 to the position P6, and thus the outboard motors 12 and 13 generate the propulsion force F32 in the leftward-forward direction which has the smaller leftward-rightward direction component F32L. As a result, also in this example, the ship operator can move the ship 1 in the leftward direction without the ship 1 being swept in the backward direction.

For example, when the ship does not receive a force in a forward-backward direction due to wind, tidal current, and the like, the ship operator may switch (correct) the direction of the ship 1 moving in the leftward direction (translational movement) from the leftward direction to the leftward-forward direction.

In such a case, as in the example shown in FIG. 5C, first, the operation unit 11D (the tip end portion of the lever of the joystick) is moved from the position P1 to the position P5. To switch the direction of the ship 1 moving in the leftward direction from the leftward direction to the leftward-forward direction, the operation unit 11D (the tip end portion of the lever of the joystick) is then moved from the position P5 to the position P6.

That is, in the example shown in FIG. 5C, the operation unit 11D (the tip end portion of the lever of the joystick) is moved from the position P1 to the position P6 via the position P5.

The movement route calculation unit 14A calculates a movement route P1→P5→P6 of the tip end portion of the lever of the joystick based on the position of the lever when the tip end portion of the lever of the joystick is located at the position P1, the position of the lever when the tip end portion of the lever of the joystick is located at the position P5, and the position of the lever when the tip end portion of the lever of the joystick is located at the position P6.

The propulsion force calculation unit 14B calculates the propulsion force which the outboard motors 12 and 13 generate based on the movement route P1→P5→P6 of the tip end portion of the lever of the joystick which is calculated by the movement route calculation unit 14A. Specifically, the propulsion force calculation unit 14B calculates the magnitude of the propulsion force for switching the direction of the ship 1 moving in the leftward direction from the leftward direction to the leftward-forward direction (that is, the propulsion force in the leftward-forward direction).

The control device 14 for an outboard motor causes the steering actuators 12A2 and 13A2 and the propulsion units 12A1 and 13A1 to generate the propulsion force in the leftward-forward direction which has the magnitude calculated by the propulsion force calculation unit 14B.

In the example shown in FIG. 5C, the control device 14 for an outboard motor causes the steering actuators 12A2 and 13A2 and the propulsion units 12A1 and 13A1 to generate the propulsion force F32 in the leftward-forward direction in which the forward-backward direction component is larger than that in the example shown in FIG. 5B (specifically, the forward direction component F32F is larger than the forward direction component F31F). As a result, the direction of the ship 1 can be quickly switched from the leftward direction to the leftward-forward direction according to the desire of the ship operator.

In another example, the control device 14 for an outboard motor causes the steering actuators 12A2 and 13A2 and the propulsion units 12A1 and 13A1 to generate the propulsion force F32 in the leftward-forward direction in which the leftward-rightward direction component is smaller than that in the example shown in FIG. 5B (specifically, the forward direction component F32F and the forward direction component F31F are equal to each other, and the leftward direction component F32L is smaller than the leftward direction component F31L). As a result, also in this example, the direction of the ship 1 can be quickly switched from the leftward direction to the leftward-forward direction according to the desire of the ship operator.

Further, the ship operator may want to move the ship 1 in the leftward-backward direction (translational movement).

Figure 5D:
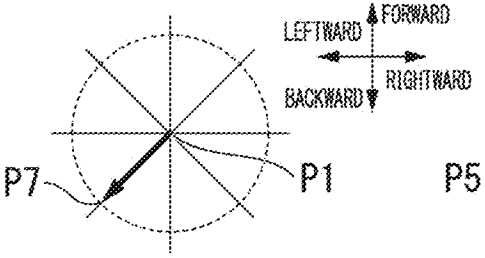

In such a case, as in the example shown in FIG. 5D, the operation unit 11D (the tip end portion of the lever of the joystick) is moved from the position P1 to the position P7.

The movement route calculation unit 14A calculates a movement route P1→P7 of the tip end portion of the lever of the joystick based on the position of the lever when the tip end portion of the lever of the joystick is located at the position P1 and the position of the lever when the tip end portion of the lever of the joystick is located at the position P7.

The propulsion force calculation unit 14B calculates the propulsion force which the outboard motors 12 and 13 generate based on the movement route P1→P7 of the tip end portion of the lever of the joystick which is calculated by the movement route calculation unit 14A. Specifically, the propulsion force calculation unit 14B calculates the magnitude of the propulsion force for moving the ship 1 in the leftward-backward direction.

The control device 14 for an outboard motor causes the steering actuators 12A2 and 13A2 and the propulsion units 12A1 and 13A1 to generate the propulsion force in the leftward-backward direction which has the magnitude calculated by the propulsion force calculation unit 14B.

As a result, the ship 1 moves in the leftward-backward direction (translational movement).

In a case in which the ship operator wants to move the ship 1 in the leftward direction (translational movement), the ship 1 may receive a force in a forward direction due to, for example, wind, tidal current, and the like.

Figure 5E:
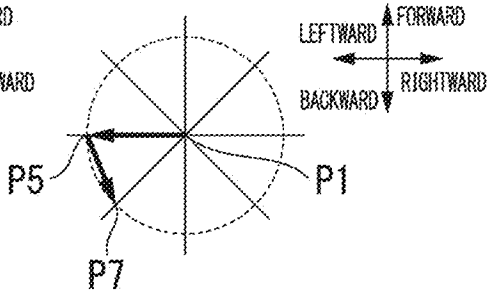

In such a case, as in the example shown in FIG. 5E, first, the operation unit 11D (the tip end portion of the lever of the joystick) is moved from the position P1 to the position P5. Since the ship 1 is likely to be swept in the forward direction by the force in the forward direction due to wind, tidal current, and the like, the operation unit 11D (the tip end portion of lever of the joystick) is then moved from the position P5 to the position P7.

That is, in the example shown in FIG. 5E, the operation unit 11D (the tip end portion of the lever of the joystick) is moved from the position P1 to the position P7 via the position P5.

The movement route calculation unit 14A calculates a movement route P1→P5→P7 of the tip end portion of the lever of the joystick based on the position of the lever when the tip end portion of the lever of the joystick is located at the position P1, the position of the lever when the tip end portion of the lever of the joystick is located at the position P5, and the position of the lever when the tip end portion of the lever of the joystick is located at the position P7.

The propulsion force calculation unit 14B calculates the propulsion force which the outboard motors 12 and 13 generate based on the movement route P1→P5→P7 of the tip end portion of the lever of the joystick which is calculated by the movement route calculation unit 14A. Specifically, the propulsion force calculation unit 14B calculates the magnitude of the propulsion force (that is, the propulsion force in the leftward-backward direction) for moving the ship 1 in the leftward direction against the force in the forward direction due to, for example, wind, tidal current, and the like.

The control device 14 for an outboard motor causes the steering actuators 12A2 and 13A2 and the propulsion units 12A1 and 13A1 to generate the propulsion force in the leftward-backward direction which has the magnitude calculated by the propulsion force calculation unit 14B.

In the example shown in FIG. 5E, the control device 14 for an outboard motor causes the steering actuators 12A2 and 13A2 and the propulsion units 12A1 and 13A1 to generate the propulsion force in the leftward-backward direction which has the forward-backward direction component (specifically, a backward direction component) larger than that in the example shown in FIG. 5D.

As a result, the ship 1 moves in the leftward direction (translational movement) according to the desire of the ship operator and against the force in the forward direction due to, for example, wind, tidal current, and the like.

Figure 7C:
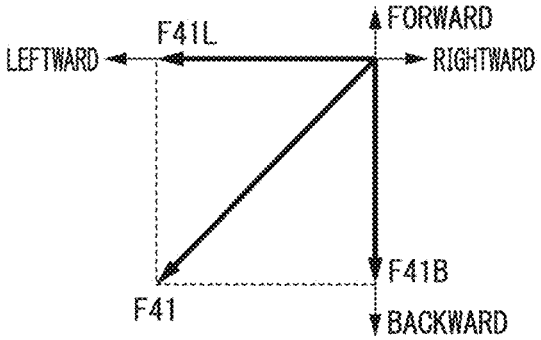

FIG. 7C shows a propulsion force F41 in a leftward-backward direction which the control device 14 for an outboard motor causes the outboard motors 12 and 13 to generate (that is, which is calculated by the propulsion force calculation unit 14B), a forward-backward direction component F41B thereof, and a leftward-rightward direction component F41L thereof in a case in which the operation unit 11D (the tip end portion of the lever of the joystick) is moved directly from the position P1 to the position P7 (in the example shown in FIG. 5D).

Figure 7D:
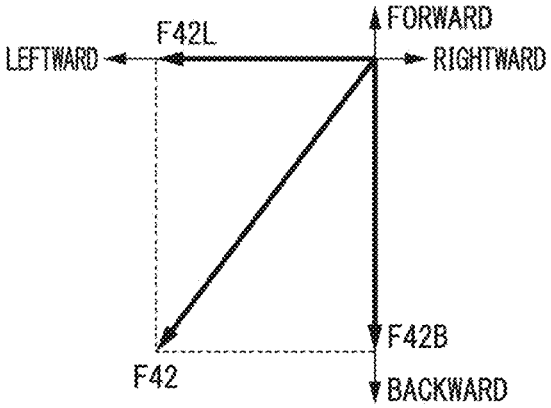

FIG. 7D shows a propulsion force F42 in a leftward-backward direction which the control device 14 for an outboard motor causes the outboard motors 12 and 13 to generate (that is, which is calculated by the propulsion force calculation unit 14B), a forward-backward direction component F42B thereof, and a leftward-rightward direction component F42L thereof in a case in which the operation unit 11D (the tip end portion of the lever of the joystick) is moved from the position P1 to the position P7 via the position P5 (in the example shown in FIG. 5E).

In the examples shown in FIG. 7C and FIG. 7D, the magnitude of the leftward-rightward direction component F41L of the propulsion force F41 in the leftward-backward direction and the magnitude of the leftward-rightward direction component F42L of the propulsion force F42 in the leftward-backward direction are set to be equal to each other. Further, the forward-backward direction component F42B of the propulsion force F42 in the leftward-backward direction is set to be larger than the forward-backward direction component F41B of the propulsion force F41 in the leftward-backward direction. As a result, the propulsion force F42 in the leftward-backward direction is also larger than the propulsion force F41 in the leftward-backward direction.

Therefore, in the examples shown in FIG. 7C and FIG. 7D, even in a case in which the ship 1 receives the force in the forward direction during a period in which the ship 1 is moved in the leftward direction by the ship operator moving the operation unit 11D (the tip end portion of the lever of the joystick) from the position P1 to the position P5, the ship operator moves the operation unit 11D (the tip end portion of the lever of the joystick) from the position P5 to the position P7, and thus the outboard motors 12 and 13 generate the propulsion force F42 in the leftward-backward direction which has the larger forward-backward direction component F42B. As a result, the ship operator can move the ship 1 in the leftward direction without the ship 1 being swept in the forward direction.

In the examples shown in FIG. 7C and FIG. 7D, as described above, the magnitude of the leftward-rightward direction component F41L of the propulsion force F41 in the leftward-backward direction and the magnitude of the leftward-rightward direction component F42L of the propulsion force F42 in the leftward-backward direction are set to be equal to each other. Further, the forward-backward direction component F42B of the propulsion force F42 in the leftward-backward direction is set to be larger than the forward-backward direction component F41B of the propulsion force F41 in the leftward-backward direction.

In another example, the magnitude of the forward-backward direction component F42B of the propulsion force F42 in the leftward-backward direction and the magnitude of the forward-backward direction component F41B of the propulsion force F41 in the leftward-backward direction are set to be equal to each other, and the leftward-rightward direction component F42L of the propulsion force F42 in the leftward-backward direction is set smaller than the leftward-rightward direction component F41L of the propulsion force F41 in the leftward-backward direction. That is, in this example, the propulsion force F42 in the leftward-backward direction is smaller than the propulsion force F41 in the leftward-backward direction.

Therefore, in this example, even in a case in which the ship 1 receives the force in the forward direction during a period in which the ship 1 is moved in the leftward direction by the ship operator moving the operation unit 11D (the tip end portion of the lever of the joystick) from the position P1 to the position P5, the ship operator moves the operation unit 11D (the tip end portion of the lever of the joystick) from the position P5 to the position P7, and thus the outboard motors 12 and 13 generate the propulsion force F42 in the leftward-backward direction which has the smaller leftward-rightward direction component F42L. As a result, also in this example, the ship operator can move the ship 1 in the leftward direction without the ship 1 being swept in the forward direction.

For example, when the ship does not receive a force in a forward-backward direction due to wind, tidal current, and the like, the ship operator may switch (correct) the direction of the ship 1 moving in the leftward direction (translational movement) from the leftward direction to the leftward-backward direction.

In such a case, as in the example shown in FIG. 5E, first, the operation unit 11D (the tip end portion of the lever of the joystick) is moved from the position P1 to the position P5. To switch the direction of the ship 1 moving in the leftward direction from the leftward direction to the leftward-backward direction, the operation unit 11D (the tip end portion of the lever of the joystick) is then moved from the position P5 to the position P7.

That is, in the example shown in FIG. 5E, the operation unit 11D (the tip end portion of the lever of the joystick) is moved from the position P1 to the position P7 via the position P5.

The movement route calculation unit 14A calculates a movement route P1→P5→P7 of the tip end portion of the lever of the joystick based on the position of the lever when the tip end portion of the lever of the joystick is located at the position P1, the position of the lever when the tip end portion of the lever of the joystick is located at the position P5, and the position of the lever when the tip end portion of the lever of the joystick is located at the position P7.

The propulsion force calculation unit 14B calculates the propulsion force which the outboard motors 12 and 13 generate based on the movement route P1→P5→P7 of the tip end portion of the lever of the joystick which is calculated by the movement route calculation unit 14A. Specifically, the propulsion force calculation unit 14B calculates the magnitude of the propulsion force for switching the direction of the ship 1 moving in the leftward direction from the leftward direction to the leftward-backward direction (that is, the propulsion force in the leftward-backward direction).

The control device 14 for an outboard motor causes the steering actuators 12A2 and 13A2 and the propulsion units 12A1 and 13A1 to generate the propulsion force in the leftward-backward direction which has the magnitude calculated by the propulsion force calculation unit 14B.

In the example shown in FIG. 5E, the control device 14 for an outboard motor causes the steering actuators 12A2 and 13A2 and the propulsion units 12A1 and 13A1 to generate the propulsion force F42 in the leftward-backward direction in which the forward-backward direction component is larger than that in the example shown in FIG. 5D (specifically, the backward direction component F42B is larger than the backward direction component F41B). As a result, the direction of the ship 1 can be quickly switched from the leftward direction to the leftward-backward direction according to the desire of the ship operator.

In another example, the control device 14 for an outboard motor causes the steering actuators 12A2 and 13A2 and the propulsion units 12A1 and 13A1 to generate the propulsion force F42 in the leftward-backward direction in which the leftward-rightward direction component is smaller than that in the example shown FIG. 5D (specifically, the backward direction component F42B and the backward direction component F41B are equal to each other, and the leftward direction component F42L is smaller than the leftward direction component F41L). As a result, also in this example, the direction of the ship 1 can be quickly switched from the leftward direction to the leftward-backward direction according to the desire of the ship operator.

Figure 8:
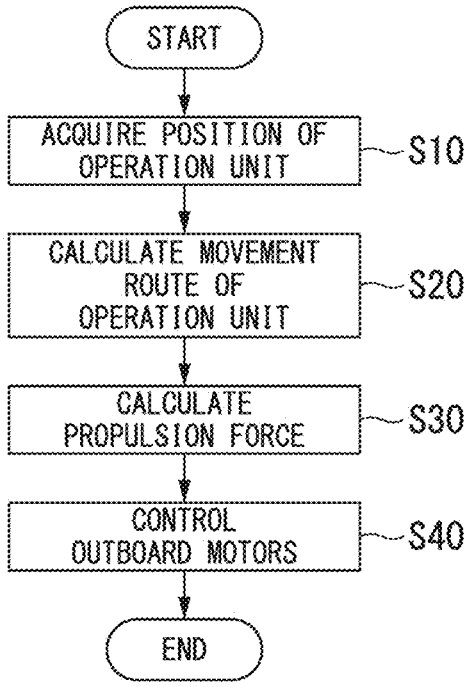
FIG. 8 is a flowchart for explaining an example of processing executed by the control device for an outboard motor of the first embodiment.

FIG. 8 is a flowchart for explaining an example of processing executed by the control device 14 for an outboard motor of the first embodiment.

The processing shown in FIG. 8 starts in a case in which the operation unit 11D (the joystick) receives an input operation for operating the steering actuators 12A2 and 13A2 and the propulsion units 12A1 and 13A1 of the outboard motors 12 and 13.

In the example shown in FIG. 8, in step S10, the control device 14 for an outboard motor acquires the position of the operation unit 11D (the position of the lever of the joystick) detected by, for example, a sensor such as a micro switch.

Next, in step S20, the movement route calculation unit 14A of the control device 14 for an outboard motor calculates the movement route of the operation unit 11D (the movement route of the tip end portion of the lever of the joystick) based on a plurality of positions of the operation unit 11D (a plurality of positions of the lever of the joystick) acquired in step S10.

Next, in step S30, the propulsion force calculation unit 14B of the control device 14 for an outboard motor calculates the propulsion force which the steering actuators 12A2 and 13A2 and the propulsion units 12A1 and 13A1 generate based on the movement route of the operation unit 11D (the movement route of the tip end portion of the lever of the joystick) which is calculated in step S20.

Next, in step S40, the control device 14 for an outboard motor controls the steering actuators 12A2 and 13A2 and the propulsion units 12A1 and 13A1 of the outboard motors 12 and 13 such that the steering actuators 12A2 and 13A2 and the propulsion units 12A1 and 13A1 of the outboard motors 12 and 13 generate the propulsion force calculated in step S20.

Specifically, in step S20, in a case in which the movement route calculation unit 14A calculates the movement route P1→P3 (see (B) of FIG. 4) of the tip end portion of the lever of the joystick, in step S30, the propulsion force calculation unit 14B calculates the propulsion force F11 in the rightward-forward direction (see FIG. 6A) which has the forward-backward direction component F11F (see A) and the leftward-rightward direction component F11R (see FIG. 6A), and next, in step S40, the control device 14 for an outboard motor causes the outboard motors 12 and 13 to generate the propulsion force F11 in the rightward-forward direction.

On the other hand, in step S20, in a case in which the movement route calculation unit 14A calculates the movement route P1→P2→P3 (see FIG. 4C) of the tip end portion of the lever of the joystick, in step S30, the propulsion force calculation unit 14B calculates the propulsion force F12 (>F11) in the rightward-forward direction (see FIG. 6B) which has the forward-backward direction component F12F (>F11F) (see FIG. 6B) and the leftward-rightward direction component F12R (=F11R) (see FIG. 6B), and next, in step S40, the control device 14 for an outboard motor causes the outboard motors 12 and 13 to generate the propulsion force F12 in the rightward-forward direction.

In another example, in step S20, in a case in which the movement route calculation unit 14A calculates the movement route P1→P2→P3 (see FIG. 4C) of the tip end portion of the lever of the joystick, in step S30, the propulsion force calculation unit 14B calculates the propulsion force F12 (<F11) in the rightward-forward direction (see FIG. 6B) which has the forward-backward direction component F12F (=F11F) (see FIG. 6B) and the leftward-rightward direction component F12R (<F11R) (see FIG. 6B), and next, in step S40, the control device 14 for an outboard motor causes the outboard motors 12 and 13 to generate the propulsion force F12 in the rightward-forward direction.

Further, in the example shown in FIG. 8, in step S20, in a case in which the movement route calculation unit 14A calculates the movement route P1→P4 (see FIG. 4D) of the tip end portion of the lever of the joystick, in step S30, the propulsion force calculation unit 14B calculates the propulsion force F21 in the rightward-backward direction (see FIG. 6C) which has the forward-backward direction component F21B (see FIG. 6C) and the leftward-rightward direction component F21R (see FIG. 6C), and next, in step S40, the control device 14 for an outboard motor causes the outboard motors 12 and 13 to generate the propulsion force F21 in the rightward-backward direction.

On the other hand, in step S20, in a case in which the movement route calculation unit 14A calculates the movement route P1→P2→P4 (see (E) of FIG. 4) of the tip end portion of the lever of the joystick, in step S30, the propulsion force calculation unit 14B calculates the propulsion force F22 (>F21) in the rightward-backward direction (see FIG. 6D) which has the forward-backward direction component F22B (>F21B) (see FIG. 6D) and the leftward-rightward direction component F22R (=F21R) (see FIG. 6D), and next, in step S40, the control device 14 for an outboard motor causes the outboard motors 12 and 13 to generate the propulsion force F22 in the rightward-backward direction.

In another example, in step S20, in a case in which the movement route calculation unit 14A calculates the movement route P1→P2→P4 (see (E) of FIG. 4) of the tip end portion of the lever of the joystick, in step S30, the propulsion force calculation unit 14B calculates the propulsion force F22 (<F21) in the rightward-backward direction (see FIG. 6D) which has the forward-backward direction component F22B (=F21B) (see FIG. 6D) and the leftward-rightward direction component F22R (<F21R) (see FIG. 6D), and next, in step S40, the control device 14 for an outboard motor causes the outboard motors 12 and 13 to generate the propulsion force F22 in the rightward-backward direction.

Further, in the example shown in FIG. 8, in step S20, in a case in which the movement route calculation unit 14A calculates the movement route P1→P6 (see FIG. 5B) of the tip end portion of the lever of the joystick, in step S30, the propulsion force calculation unit 14B calculates the propulsion force F31 in the leftward-forward direction (see FIG. 7A) which has the forward-backward direction component F31F (see FIG. 7A) and the leftward-rightward direction component F31L (see FIG. 7A), and next, in step S40, the control device 14 for an outboard motor causes the outboard motors 12 and 13 to generate the propulsion force F31 in the leftward-forward direction.

On the other hand, in step S20, in a case in which the movement route calculation unit 14A calculates the movement route P1→P5→P6 (see FIG. 5C) of the tip end portion of the lever of the joystick, in step S30, the propulsion force calculation unit 14B calculates the propulsion force F32 (>F31) in the leftward-forward direction (see FIG. 7B) which has the forward-backward direction component F32F (>F31F) (see FIG. 7B) and the leftward-rightward direction component F32L (=F31L) (see FIG. 7B), and next, in step S40, the control device 14 for an outboard motor causes the outboard motors 12 and 13 to generate the propulsion force F32 in the leftward-forward direction.

In another example, in step S20, in a case in which the movement route calculation unit 14A calculates the movement route P1→P5→P6 (see (C) of FIG. 5) of the tip end portion of the lever of the joystick, in step S30, the propulsion force calculation unit 14B calculates the propulsion force F32 (<F31) in the leftward-forward direction (see FIG. 7B) which has the forward-backward direction component F32F (=F31F) (see FIG. 7B) and the leftward-rightward direction component F32L (<F31L) (see FIG. 7B), and next, in step S40, the control device 14 for an outboard motor causes the outboard motors 12 and 13 to generate the propulsion force F32 in the leftward-forward direction.

Further, in the example shown in FIG. 8, in step S20, in a case in which the movement route calculation unit 14A calculates the movement route P1→P7 (see FIG. 5D) of the tip end portion of the lever of the joystick, in step S30, the propulsion force calculation unit 14B calculates the propulsion force F41 in the leftward-backward direction (see FIG. 7C) which has the forward-backward direction component F41B (see C) and the leftward-rightward direction component F41L (see FIG. 7C), and next, in step S40, the control device 14 for an outboard motor causes the outboard motors 12 and 13 to generate the propulsion force F41 in the leftward-backward direction.

On the other hand, in step S20, in a case in which the movement route calculation unit 14A calculates the movement route P1→P5→P7 (see (E) of FIG. 5) of the tip end portion of the lever of the joystick, in step S30, the propulsion force calculation unit 14B calculates the propulsion force F42 (>F41) in the leftward-backward direction (see FIG. 7D) which has the forward-backward direction component F42B (>F41B) (see FIG. 7D) and the leftward-rightward direction component F42L (=F41L) (see FIG. 7D), and next, in step S40, the control device 14 for an outboard motor causes the outboard motors 12 and 13 to generate the propulsion force F42 in the leftward-backward direction.

In another example, in step S20, in a case in which the movement route calculation unit 14A calculates the movement route P1→P5→P7 (see (E) of FIG. 5) of the tip end portion of the lever of the joystick, in step S30, the propulsion force calculation unit 14B calculates the propulsion force F42 (<F41) in the leftward-backward direction (see FIG. 7D) which has the forward-backward direction component F42B (=F41B) (see FIG. 7D) and the leftward-rightward direction component F42L (<F41L) (see FIG. 7D), and next, in step S40, the control device 14 for an outboard motor causes the outboard motors 12 and 13 to generate the propulsion force F42 in the leftward-backward direction.

Second Embodiment

Hereinafter, a second embodiment of a control device for an outboard motor, a control method for an outboard motor, and a program of the present invention will be described.

A ship 1 to which a control device 14 for an outboard motor of the second embodiment is applied has the same configuration as the ship 1 to which the control device 14 for an outboard motor of the first embodiment described above is applied, except for the points which will be described later. Therefore, according to the ship 1 of the second embodiment, the same effect as that of the ship 1 of the first embodiment described above can be obtained except for the points which will be described later.

Figure 9:
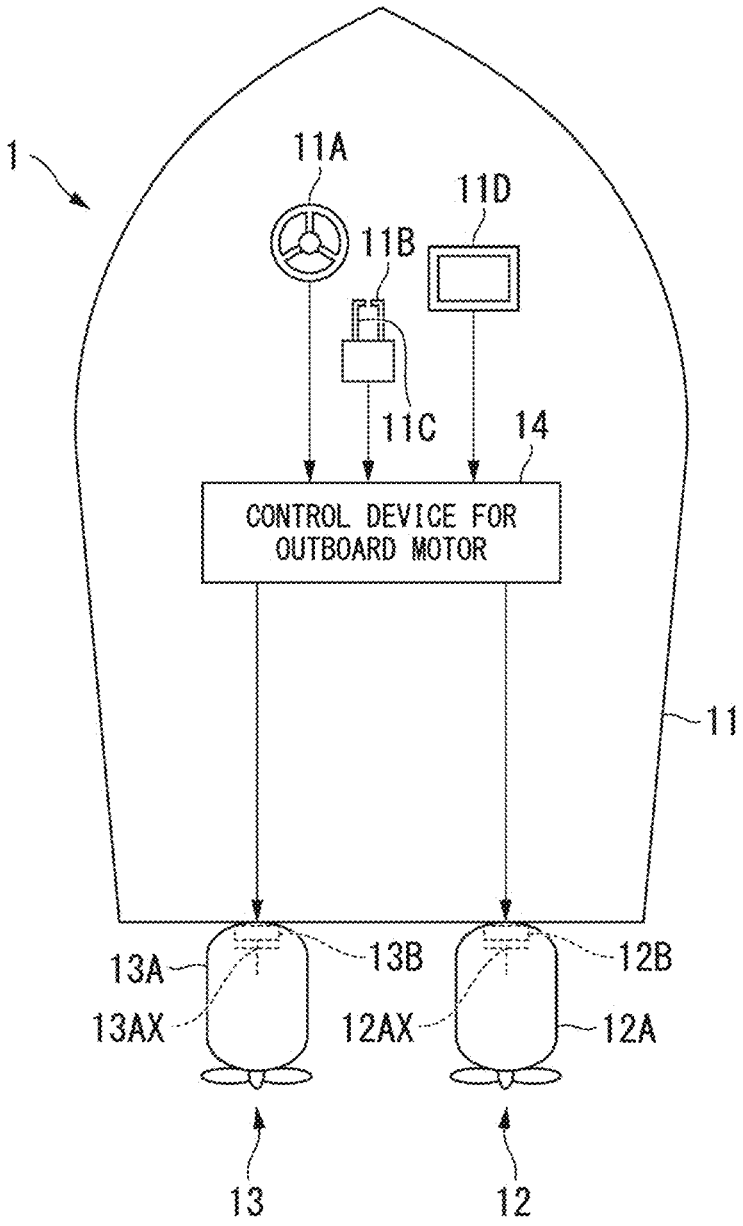
FIG. 9 is a diagram showing an example of a ship to which a control device for an outboard motor of a second embodiment is applied.

FIG. 9 is a diagram showing an example of a ship to which a control device 14 for an outboard motor of the second embodiment is applied.

As described above, in the ship 1 of the first embodiment (the example shown in FIGS. 1 and FIG. 2), the operation unit 11D is constituted by a joystick having a lever.

On the other hand, in the ship 1 of the second embodiment (the example shown in FIG. 9), the operation unit 11D is constituted by a touch panel. By operating the steering device 11A (the steering wheel) and the remote control devices 11B and 11C (the remote control lever), the ship operator can operate the steering actuators 12A2 and 13A2 and the propulsion units 12A1 and 13A1, and also by operating the operation unit 11D (the touch panel), the ship operator can operate the steering actuators 12A2 and 13A2 and the propulsion units 12A1 and 13A1.

In another example, the ship hull 11 may not include the steering device 11A, the remote control device 11B, and the remote control device 11C.

In the example shown in FIG. 9, the control device 14 for an outboard motor controls the steering actuator 12A2 and the propulsion unit 12A1 of the outboard motor 12 and the steering actuator 13A2 and the propulsion unit 13A1 of the outboard motor 13 based on the input operation to the operation unit 11D.

Specifically, the control device 14 for an outboard motor controls the magnitude and direction of the propulsion force for the ship 1 which is generated by the steering actuators 12A2 and 13A2 and the propulsion units 12A1 and 13A1 based on, for example, a flick input operation to the operation unit 11D (the touch panel).

In the flick input operation, the ship operator slides a finger pressing the touch panel in a desired direction while the finger presses the touch panel, for example.

The movement route calculation unit 14A calculates a movement route of the operation unit 11D. Specifically, the movement route calculation unit 14A calculates the movement route of the finger that the ship operator slides while the finger presses the touch panel.

The propulsion force calculation unit 14B calculates the propulsion force which the outboard motors 12 and 13 generate based on the movement route of the operation unit 11D which is calculated by the movement route calculation unit 14A (the movement route of the finger that the ship operator slides while the finger presses the touch panel).

In the example shown in FIG. 9, the operation unit 11D is configured such that a flick input operation can be performed on the operation unit 11D (the touch panel) and the rotation input operation can be performed on the operation unit 11D (the touch panel).

The ship operator performs the rotation input operation by, for example, sliding one finger in a circumferential direction while the finger presses the touch panel in a state in which the other finger is brought into contact with the touch panel and is fixed as a center point.

In a case in which the ship operator performs the rotation input operation on the operation unit 11D (the touch panel) clockwise, the control device 14 for an outboard motor controls the steering actuators 12A2 and 13A2 and the propulsion units 12A1 and 13A1 such that the ship hull 11 turns to the right. On the other hand, in a case in which the ship operator performs the rotation input operation on the operation unit 11D (the touch panel) counterclockwise, the control device 14 for an outboard motor controls the steering actuators 12A2 and 13A2 and the propulsion units 12A1 and 13A1 such that the ship hull 11 turns to the left.

Further, in a case in which the ship operator performs the flick input operation on the operation unit 11D (the touch panel), the control device 14 for an outboard motor controls the steering actuators 12A2 and 13A2 and the propulsion units 12A1 and 13A1 such that the ship hull 11 moves in a direction that the finger of the ship operator is slid while maintaining its posture. That is, when ship operator performs a flick input operation on the operation unit 11D (the touch panel), the front portion of the ship hull 11 and the rear portion of the hull 11 are translated.

In a case in which the ship operator does not perform a flick input operation on the operation unit 11D (the touch panel) (that is, in a case in which the finger of the ship operator is not in contact with the touch panel), the operation unit 11D is in the same state as the state shown in FIG. 3A. As a result, the control device 14 for an outboard motor does not cause the steering actuators 12A2 and 13A2 and the propulsion units 12A1 and 13A1 to generate the propulsion force for the ship 1.

In a first example of the ship 1 of the second embodiment, the ship operator slides the finger in the rightward direction while the finger presses the touch panel and maintains the state in which the touch panel is pressed by the finger. In that case, the operation unit 11D is in the same state as the state shown in FIG. 3B.

The movement route calculation unit 14A calculates the movement route (a contact start position→a current position) of the operation unit 11D based on the contact start position of the finger of the ship operator and the current position of the finger of the ship operator.

The propulsion force calculation unit 14B calculates the propulsion force which the outboard motors 12 and 13 generate based on the movement route (the contact start position→the current position) of the operation unit 11D which is calculated by the movement route calculation unit 14A. Specifically, the propulsion force calculation unit 14B calculates the magnitude of the propulsion force for moving the ship 1 in the rightward direction.

The control device 14 for an outboard motor causes the steering actuators 12A2 and 13A2 and the propulsion units 12A1 and 13A1 to generate the propulsion force in the rightward direction which has the magnitude calculated by the propulsion force calculation unit 14B.

In a second example of the ship 1 of the second embodiment, the ship operator moves the ship 1 in the rightward-forward direction (translational movement).

Specifically, the ship operator slides the finger in the rightward-forward direction while the finger presses the touch panel and maintains the state in which the touch panel is pressed by the finger. As a result, the operation unit 11D is in the same state as the state shown in FIG. 3C.

The movement route calculation unit 14A calculates the movement route (a contact start position→a current position) of the operation unit 11D based on the contact start position of the finger of the ship operator and the current position of the finger of the ship operator moved in the rightward-forward direction.

The propulsion force calculation unit 14B calculates the propulsion force which the outboard motors 12 and 13 generate based on the movement route (the contact start position→the current position) of the operation unit 11D which is calculated by the movement route calculation unit 14A. Specifically, the propulsion force calculation unit 14B calculates the magnitude of the propulsion force for moving the ship 1 in the rightward-forward direction.

The control device 14 for an outboard motor causes the steering actuators 12A2 and 13A2 and the propulsion units 12A1 and 13A1 to generate the propulsion force in the rightward-forward direction which has the magnitude calculated by the propulsion force calculation unit 14B.

In a third example of the ship 1 of the second embodiment, when the ship operator moves the ship 1 in the rightward direction (translational movement), the ship 1 receives a force in a backward direction due to, for example, wind, tidal current, and the like.

Specifically, first, the ship operator slides the finger in the rightward direction while the finger presses the touch panel and maintains the state in which the touch panel is pressed by the finger. Since the ship 1 is likely to be swept in the backward direction by the force in the backward direction due to wind, tidal current, and the like, next, the ship operator further slides the finger in the forward direction while the finger presses the touch panel and maintains the state in which the touch panel is pressed by the finger.

The movement route calculation unit 14A calculates the movement route (a contact start position→a rightward direction movement end position→a forward direction movement end position) of the operation unit 11D based on the contact start position of the finger of the ship operator, the position of the finger of the ship operator moved in the rightward direction, and the position of the finger of the ship operator moved in the forward direction.

The propulsion force calculation unit 14B calculates the propulsion force which the outboard motors 12 and 13 generate based on the movement route (the contact start position→a rightward direction movement end position→a forward direction movement end position) of the operation unit 11D which is calculated by the movement route calculation unit 14A. Specifically, the propulsion force calculation unit 14B calculates the magnitude of the propulsion force (that is, the propulsion force in the rightward-forward direction) for moving the ship 1 in the rightward direction against the force in the backward direction due to, for example, wind, tidal current, and the like.

The control device 14 for an outboard motor causes the steering actuators 12A2 and 13A2 and the propulsion units 12A1 and 13A1 to generate the propulsion force in the rightward-forward direction which has the magnitude calculated by the propulsion force calculation unit 14B.

In the third example of the ship 1 of the second embodiment, the control device 14 for an outboard motor causes the steering actuators 12A2 and 13A2 and the propulsion units 12A1 and 13A1 to generate the propulsion force in the rightward-forward direction which has the forward-backward direction component (specifically, a forward direction component) larger than that in the second example of the ship 1 of the second embodiment.

As a result, the ship 1 moves in the rightward direction (translational movement) according to the desire of the ship operator and against the force in the backward direction due to, for example, wind, tidal current, and the like.

In a fourth example of the ship 1 of the second embodiment, the ship operator moves the ship 1 in the rightward-backward direction (translational movement).

In this case, the ship operator slides the finger in the rightward-backward direction while the finger presses the touch panel and maintains the state in which the touch panel is pressed by the finger. As a result, the operation unit 11D is in the same state as the state shown in FIG. 3D.

In a fifth example of the ship 1 of the second embodiment, when the ship operator moves the ship 1 in the rightward direction (translational movement), the ship 1 receives a force in a forward direction due to, for example, wind, tidal current, and the like.

In this example, first, the ship operator slides the finger in the rightward direction while the finger presses the touch panel and maintains the state in which the touch panel is pressed by the finger. Since the ship 1 is likely to be swept in the forward direction by the force in the backward direction due to wind, tidal current, and the like, next, the ship operator further slides the finger in the backward direction while the finger presses the touch panel and maintains the state in which the touch panel is pressed by the finger.

In the fifth example of the ship 1 of the second embodiment, the control device 14 for an outboard motor causes the steering actuators 12A2 and 13A2 and the propulsion units 12A1 and 13A1 to generate the propulsion force in the rightward-backward direction which has the forward-backward direction component (specifically, a backward direction component) larger than that in the fourth example of the ship 1 of the second embodiment.

As a result, the ship 1 moves in the rightward direction (translational movement) according to the desire of the ship operator and against the force in the forward direction due to, for example, wind, tidal current, and the like.

In a sixth example of the ship 1 of the second embodiment, the ship operator slides the finger in the leftward direction while the finger presses the touch panel and maintains the state in which the touch panel is pressed by the finger. In that case, the operation unit 11D is in the same state as the state shown in FIG. 3E.

The movement route calculation unit 14A calculates the movement route (a contact start position→a current position) of the operation unit 11D based on the contact start position of the finger of the ship operator and the current position of the finger of the ship operator.

The propulsion force calculation unit 14B calculates the propulsion force which the outboard motors 12 and 13 generate based on the movement route (the contact start position→the current position) of the operation unit 11D which is calculated by the movement route calculation unit 14A. Specifically, the propulsion force calculation unit 14B calculates the magnitude of the propulsion force for moving the ship 1 in the leftward direction.

The control device 14 for an outboard motor causes the steering actuators 12A2 and 13A2 and the propulsion units 12A1 and 13A1 to generate the propulsion force in the leftward direction which has the magnitude calculated by the propulsion force calculation unit 14B.

In a seventh example of the ship 1 of the second embodiment, the ship operator moves the ship 1 in the leftward-forward direction (translational movement).

In this case, the ship operator slides the finger in the leftward-forward direction while the finger presses the touch panel and maintains the state in which the touch panel is pressed by the finger. As a result, the operation unit 11D is in the same state as the state shown in FIG. 3F.

In an eighth example of the ship 1 of the second embodiment, when the ship operator moves the ship 1 in the leftward direction (translational movement), the ship 1 receives a force in a backward direction due to, for example, wind, tidal current, and the like.

In this example, first, the ship operator slides the finger in the leftward direction while the finger presses the touch panel and maintains the state in which the touch panel is pressed by the finger. Since the ship 1 is likely to be swept in the backward direction by the force in the backward direction due to wind, tidal current, and the like, next, the ship operator further slides the finger in the forward direction while the finger presses the touch panel and maintains the state in which the touch panel is pressed by the finger.

In the eighth example of the ship 1 of the second embodiment, the control device 14 for an outboard motor causes the steering actuators 12A2 and 13A2 and the propulsion units 12A1 and 13A1 to generate the propulsion force in the leftward-forward direction which has the forward-backward direction component (specifically, a forward direction component) larger than that in the seventh example of the ship 1 of the second embodiment.

As a result, the ship 1 moves in the leftward direction (translational movement) according to the desire of the ship operator and against the force in the backward direction due to, for example, wind, tidal current, and the like.

In a ninth example of the ship 1 of the second embodiment, the ship operator moves the ship 1 in the leftward-backward direction (translational movement).

In this case, the ship operator slides the finger in the leftward-backward direction while the finger presses the touch panel and maintains the state in which the touch panel is pressed by the finger. As a result, the operation unit 11D is in the same state as the state shown in (G) of FIG. 3G.

In a tenth example of the ship 1 of the second embodiment, when the ship operator moves the ship 1 in the leftward direction (translational movement), the ship 1 receives a force in a forward direction due to, for example, wind, tidal current, and the like.

In this example, first, the ship operator slides the finger in the leftward direction while the finger presses the touch panel and maintains the state in which the touch panel is pressed by the finger. Since the ship 1 is likely to be swept in the forward direction by the force in the backward direction due to wind, tidal current, and the like, next, the ship operator further slides the finger in the backward direction while the finger presses the touch panel and maintains the state in which the touch panel is pressed by the finger.

In the tenth example of the ship 1 of the second embodiment, the control device 14 for an outboard motor causes the steering actuators 12A2 and 13A2 and the propulsion units 12A1 and 13A1 to generate the propulsion force in the leftward-backward direction which has the forward-backward direction component (specifically, a backward direction component) larger than that in the ninth example of the ship 1 of the second embodiment.

As a result, the ship 1 moves in the leftward direction (translational movement) according to the desire of the ship operator and against the force in the forward direction due to, for example, wind, tidal current, and the like.

Although the forms for carrying out the present invention have been described above using the embodiments, the present invention is not limited to these embodiments, and it is possible to make various modifications and substitutions without departing from the gist of the present invention. The configurations described in the above-described embodiments and examples may be combined.

All or some of the functions of each part of the control device 14 for an outboard motor in the above-described embodiment may be realized by recording a program for realizing these functions on a computer-readable recording medium, loading the program recorded on the recording medium into a computer system, and executing the program. The term "computer system" as used herein includes an OS and hardware such as peripheral devices.

The "computer-readable recording medium" refers to a portable medium such as a flexible disk, a magneto-optical disk, a ROM, and a CD-ROM, or a storage unit such as a hard disk built in a computer system. Further, a "computer-readable recording medium" may include a medium that dynamically holds a program for a short period of time, for example, a communication line for transmitting a program via a network such as the Internet or a communication channel such as a telephone line, and a medium that holds a program for a certain period of time, for example, a volatile memory inside a computer system serving as a server or a client in that case. Further, the above-described program may be a program for realizing some of the above-mentioned functions and may be a program for realizing the above-mentioned functions in combination with a program already recorded in the computer system.

REFERENCE SIGNS LIST

1 Ship
11 Ship hull
11A Steering device
11B Remote control device
11C Remote control device
11D Operation unit
P1 Position
P2 Position
P3 Position
P4 Position
P5 Position
P6 Position
P7 Position
P8 Position
P9 Position
12 Outboard motor
12A Outboard motor main body
12A1 Propulsion unit
12A2 Steering actuator
12AX Steering axis
12B Bracket
13 Outboard motor
13A Outboard motor main body
13A1 Propulsion unit
13A2 Steering actuator
13AX Steering axis
13B Bracket
14 Control device for outboard motor
14A Movement route calculation unit
14B Propulsion force calculation unit

What is claimed is:

1. A control device for an outboard motor which controls a plurality of outboard motors included in a ship, wherein each of the plurality of outboard motors includes a propulsion unit configured to generate a propulsion force for the ship and a steering actuator, wherein the ship includes an operation unit configured to operate the steering actuator and the propulsion unit, wherein the operation unit can be positioned at least at a first position which is a position at which the plurality of outboard motors do not generate a propulsion force for the ship, a second position which is a position at which the plurality of outboard motors generate a propulsion force for moving the ship in a leftward-rightward direction, and a third position which is a position at which the plurality of outboard motors generate a propulsion force for moving the ship in an oblique direction that forms an acute angle with the leftward-rightward direction, and wherein the outboard motor control device comprises a movement route calculation unit configured to calculates a movement route of the operation unit, a propulsion force calculation unit configured to calculates a propulsion force to be generated by the plurality of outboard motors on the basis of the movement route of the operation unit calculated by the movement route calculation unit, when the movement route calculation unit calculates a movement route of the operation unit moved from the first position to the third position via the second position, the propulsion force calculation unit calculates the first propulsion force in the oblique direction to be generated by the plurality of outboard motors on the basis of the movement route of the operation unit moved from the first position to the right position calculated by the movement route calculation unit, when the movement route calculation unit calculates a movement route of the operation unit moved from the first position to the third position via the second position, the propulsion force calculation unit calculates the second propulsion force in the oblique direction to be generated by the plurality of outboard motors on the bas is of the movement path of the operation unit moved from the first position to the right position calculated by the movement route calculation unit, wherein a forward-backward direction component of the first propulsion force is larger than a forward-backward direction component of the second propulsion force, or a leftward-rightward direction component of the first propulsion force is smaller than a leftward-rightward direction component of the second propulsion force.

2. The control device for an outboard motor according to claim 1, wherein the second position includes a rightward position which is a position on a rightward side from the first position and at which the plurality of outboard motors generate a propulsion force for moving the ship in a rightward direction and a leftward position which is a position on a leftward side from the first position and at which the plurality of outboard motors generate a propulsion force for moving the ship in a leftward direction, wherein the third position includes a rightward-forward position which is a position on a rightward-forward side from the first position and at which the plurality of outboard motors generate a propulsion force for moving the ship in a rightward-forward direction, a rightward-backward position which is a position on a rightward-backward side from the first position and at which the plurality of outboard motors generate a propulsion force for moving the ship in a rightward-backward direction, a leftward-forward position which is a position on a leftward-forward side from the first position and at which the plurality of outboard motors generate a propulsion force for moving the ship in a leftward-forward direction, and a leftward-backward position which is a position on a leftward-backward side from the first position and at which the plurality of outboard motors generate a propulsion force for moving the ship in a leftward-backward direction, wherein a forward-backward direction component of a propulsion force in the rightward-forward direction which the propulsion force calculation unit calculates in a case in which the operation unit is moved from the first position to the rightward-forward position via the rightward position is larger than a forward-backward direction component of a propulsion force in the rightward-forward direction which the propulsion force calculation unit calculates in a case in which the operation unit is moved directly from the first position to the rightward-forward position, or a leftward-rightward direction component of a propulsion force in the rightward-forward direction which the propulsion force calculation unit calculates in a case in which the operation unit is moved from the first position to the rightward-forward position via the rightward position is smaller than a leftward-rightward direction component of a propulsion force in the rightward-forward direction which the propulsion force calculation unit calculates in a case in which the operation unit is moved directly from the first position to the rightward-forward position, wherein a forward-backward direction component of a propulsion force in the rightward-backward direction which the propulsion force calculation unit calculates in a case in which the operation unit is moved from the first position to the rightward-backward position via the rightward position is larger than a forward-backward direction component of a propulsion force in the rightward-backward direction which the propulsion force calculation unit calculates in a case in which the operation unit is moved directly from the first position to the rightward-backward position, or a leftward-rightward direction component of a propulsion force in the rightward-backward direction which the propulsion force calculation unit calculates in a case in which the operation unit is moved from the first position to the rightward-backward position via the rightward position is smaller than a leftward-rightward direction component of a propulsion force in the rightward-backward direction which the propulsion force calculation unit calculates in a case in which the operation unit is moved directly from the first position to the rightward-backward position, wherein a forward-backward direction component of a propulsion force in the leftward-forward direction which the propulsion force calculation unit calculates in a case in which the operation unit is moved from the first position to the leftward-forward position via the leftward position is larger than a forward-backward direction component of a propulsion force in the leftward-forward direction which the propulsion force calculation unit calculates in a case in which the operation unit is moved directly from the first position to the leftward-forward position, or a leftward-rightward direction component of a propulsion force in the leftward-forward direction which the propulsion force calculation unit calculates in a case in which the operation unit is moved from the first position to the leftward-forward position via the leftward position is smaller than a leftward-rightward direction component of a propulsion force in the leftward-forward direction which the propulsion force calculation unit calculates in a case in which the operation unit is moved directly from the first position to the leftward-forward position, and wherein a forward-backward direction component of a propulsion force in the leftward-backward direction which the propulsion force calculation unit calculates in a case in which the operation unit is moved from the first position to the leftward-backward position via the leftward position is larger than a forward-backward direction component of a propulsion force in the leftward-backward direction which the propulsion force calculation unit calculates in a case in which the operation unit is moved directly from the first position to the leftward-backward position, or a leftward-rightward direction component of a propulsion force in the leftward-backward direction which the propulsion force calculation unit calculates in a case in which the operation unit is moved from the first position to the leftward-backward position via the leftward position is smaller than a leftward-rightward direction component of a propulsion force in the leftward-backward direction which the propulsion force calculation unit calculates in a case in which the operation unit is moved directly from the first position to the leftward-backward position.

3. A control method for an outboard motor in which a plurality of outboard motors included in a ship are controlled, wherein each of the plurality of outboard motors includes a propulsion unit configured to generate a propulsion force for the ship and a steering actuator, wherein the ship includes an operation unit configured to operate the steering actuator and the propulsion unit, wherein the operation unit can be positioned at least at a first position which is a position at which the plurality of outboard motors do not generate a propulsion force for the ship, a second position which is a position at which the plurality of outboard motors generate a propulsion force for moving the ship in a leftward-rightward direction, and a third position which is a position at which the plurality of outboard motors generate a propulsion force for moving the ship in an oblique direction that forms an acute angle with the leftward-rightward direction, wherein the method comprises:

generating a first propulsion force to be generated by the plurality of outboard motors in a first oblique direction on the basis of the movement route of the operation unit in a case in which the operation unit is moved directly from the first position to the third position;

generating a second propulsion force to be generated by the plurality of outboard motors in a second oblique direction in a case in which the operation unit is moved from the first position to the third position via the second position, and wherein a forward-backward direction component of the second propulsion force in the second oblique direction generated by the plurality of outboard motors is larger than a forward-backward direction component of the first propulsion force in the first oblique direction generated by the plurality of outboard motors, or a leftward-rightward direction component of the second propulsion force in the second oblique direction generated by the plurality of outboard motors is smaller than a leftward-rightward direction component of the first propulsion force in the first oblique direction generated by the plurality of outboard motors.

4. A program in which a plurality of outboard motors included in a ship are controlled, wherein each of the plurality of outboard motors includes a propulsion unit configured to generate a propulsion force for the ship and a steering actuator, wherein the ship includes an operation unit configured to operate the steering actuator and the propulsion unit, wherein the operation unit can be positioned at least at a first position which is a position at which the plurality of outboard motors do not generate a propulsion force for the ship, a second position which is a position at which the plurality of outboard motors generate a propulsion force for moving the ship in a leftward-rightward direction, and a third position which is a position at which the plurality of outboard motors generate a propulsion force for moving the ship in an oblique direction that forms an acute angle with the leftward-rightward direction, wherein the program causes a computer mounted on the ship to execute generating a first propulsion force to be generated by the plurality of outboard motors in a first oblique direction on the basis of the movement route of the operation unit in a case in which the operation unit is moved directly from the first position to the third position;

generating a second propulsion force to be generated by the plurality of outboard motors in a second oblique direction on the basis of the movement route of the operation unit in a case in which the operation unit is moved from the first position to the third position via the second position, and wherein a forward-backward direction component of the second propulsion force in the second oblique direction generated by the plurality of outboard motors is larger than a forward-backward direction component of the first propulsion force in the first oblique direction generated by the plurality of outboard motors, or a leftward-rightward direction component of the second propulsion force in the second oblique direction generated by the plurality of outboard motors is smaller than a leftward-rightward direction component of the first propulsion force in the first oblique direction generated by the plurality of outboard motors.

* * * * *